US009064678B2

(12) United States Patent
Ferenc

(10) Patent No.: US 9,064,678 B2
(45) Date of Patent: Jun. 23, 2015

(54) VACUUM PHOTOSENSOR DEVICE WITH ELECTRON LENSING

(71) Applicant: THE REGENTS OF THE UNIVERSITY OF CALIFORNIA, Oakland, CA (US)

(72) Inventor: Daniel Ferenc, Davis, CA (US)

(73) Assignee: THE REGENTS OF THE UNIVERSITY OF CALIFORNIA, Oakland, CA (US)

( * ) Notice: Subject to any disclaimer, the term of this patent is extended or adjusted under 35 U.S.C. 154(b) by 419 days.

(21) Appl. No.: 13/660,837

(22) Filed: Oct. 25, 2012

(65) Prior Publication Data

US 2013/0112856 A1 May 9, 2013

Related U.S. Application Data

(63) Continuation of application No. PCT/US2011/036554, filed on May 13, 2011.

(60) Provisional application No. 61/334,919, filed on May 14, 2010.

(51) Int. Cl.
*H01J 40/14* (2006.01)
*H01J 43/06* (2006.01)
(Continued)

(52) U.S. Cl.
CPC ..... *H01J 43/06* (2013.01); *H01J 43/00* (2013.01); *H01J 40/16* (2013.01)

(58) Field of Classification Search
CPC ..... H01J 40/16; H01J 43/00; H01J 31/50; H01J 43/06; G01N 27/62; H01L 31/0232
USPC ..... 250/208.1, 207, 216, 239; 313/103 R, 313/524, 528, 530, 542; 356/218, 222
See application file for complete search history.

(56) References Cited

U.S. PATENT DOCUMENTS 6,023,169 A * 2/2000 Budovich et al. ..... 324/464
6,121,675 A 9/2000 Hajime et al.
(Continued)

FOREIGN PATENT DOCUMENTS

JP 2001-326382 A 11/2001
JP 2007-042773 A 2/2007
WO 2007-098493 A2 8/2007

OTHER PUBLICATIONS

Korean Intellectual Property Office International Search Report and Written Opinion issued on Dec. 21, 2011 for corresponding International Patent Application No. PCT/US2011/036554 (pp. 1-9) and claims searched (pp. 10-16) pp. 1-16.
(Continued)

*Primary Examiner* — Georgia Y Epps
*Assistant Examiner* — Don Williams
(74) *Attorney, Agent, or Firm* — John P. O'Banion

(57) ABSTRACT

A scalable vacuum photosensor configured to simplify mass production with a housing having an evacuated first side at an ultrahigh vacuum and a second side which does not require high vacuum. The first side of the device is sealed to a base plate, having a central electron readout element, using an oxide-free sealing technique, with the deposited sealing areas serving as high voltage throughputs from the first to second sides. A conductive photocathode layer on the transparent first side converts photons to photoelectrons and concentrates the photoelectrons upon the readout. The first and second sides together form an electrostatic lens for accelerating and focusing photoelectrons upon the readout, preferably having a scintillator which generates secondary light measured by an optical detector in the second side of the housing.

25 Claims, 17 Drawing Sheets

(51) Int. Cl.
*H01J 43/00* (2006.01)
*H01J 40/16* (2006.01)

(56) References Cited

U.S. PATENT DOCUMENTS

| | | | | |
|---|---|---|---|---|
| 6,674,063 | B2 | 1/2004 | Ferenc | |
| 6,956,193 | B2 | 10/2005 | Ferenc | |
| 2002/0024300 | A1 | 2/2002 | Ferenc | |
| 2002/0167254 | A1* | 11/2002 | Craig et al. | 313/103 R |
| 2004/0150061 | A1 | 8/2004 | Hsin | |

OTHER PUBLICATIONS

Ferenc and Lorenz "Novel photosensors for neutrino detectors and telescopes," Earth Moon Planet, May 8, 2007, vol. 100, pp. 241-257.

Ferenc et al., "A new method for vacuum sealing of flat-panel photosensors," Nuclear Instruments and Methods in Physics Research A, Jun. 12, 2006, pp. 205-208.

Ferenc et al., "The novel Light Amplifier concept," Nuclear Instruments and Methods in Physics Research A, Jun. 12, 2006, vol. 567, pp. 166-171.

Lorenz and Ferenc, "A new readout of large area smart photomultipliers by Geiger-mode APDs," Nuclear Instruments and Methods in Physics Research A, Nov. 30, 2006, vol. 572, pp. 434-436.

Ferenc et al., "Solution to the ion feedback problem in hybrid photon detectors and photomultiplier tubes," Nuclear Instruments and Methods in Physics Research A, vol. 427 (1999) pp. 518-523.

Ferenc, "Imaging hybrid photon detectors with minimized dead area and protection against positive ion feedback," Nuclear Instruments and Methods in Physics Research A vol. 431 (1999) pp. 460-475.

Ferenc, "A novel photosensor concept," Nuclear Instruments and Methods in Physics Research A, vol. 471 (2001) pp. 229-233.

Ferenc et al., "First ReFerence photosensor prototype," Nuclear Instruments and Methods in Physics Research A, vol. 504 (2003) pp. 359-363.

Ferenc et al., "Development of novel photon detectors at UC Davis," Nuclear Instruments and Methods in Physics Research A, Aug. 22, 2005, vol. 553 pp. 165-171.

* cited by examiner

VACUUM PHOTOSENSOR DEVICE WITH ELECTRON LENSING

CROSS-REFERENCE TO RELATED APPLICATIONS

This application is a 35 U.S.C. §111(a) continuation of PCT international application number PCT/US2011/036554 filed on May 13, 2011, incorporated herein by reference in its entirety, which is a nonprovisional of U.S. provisional patent application Ser. No. 61/334,919 filed on May 14, 2010, incorporated herein by reference in its entirety. Priority is claimed to each of the foregoing applications.

The above-referenced PCT international application was published as PCT International Publication No. WO 2011/143638 on Nov. 17, 2011 and republished on Mar. 1, 2012.

STATEMENT REGARDING FEDERALLY SPONSORED RESEARCH OR DEVELOPMENT

This invention was made with Government support under Grant DE-FC52-04NA25684 awarded by DOE. The Government has certain rights in the invention.

INCORPORATION-BY-REFERENCE OF MATERIAL SUBMITTED ON A COMPACT DISC

Not Applicable

NOTICE OF MATERIAL SUBJECT TO COPYRIGHT PROTECTION

A portion of the material in this patent document is subject to copyright protection under the copyright laws of the United States and of other countries. The owner of the copyright rights has no objection to the facsimile reproduction by anyone of the patent document or the patent disclosure, as it appears in the United States Patent and Trademark Office publicly available file or records, but otherwise reserves all copyright rights whatsoever. The copyright owner does not hereby waive any of its rights to have this patent document maintained in secrecy, including without limitation its rights pursuant to 37 C.F.R. §1.14.

BACKGROUND OF THE INVENTION

1. Field of the Invention

This invention pertains generally to photosensor devices, and more particularly to a vacuum sealed photosensor device adapted for scalable production.

2. Description of Related Art

Existing technologies for fabricating large-area photosensors, which have not been significantly improved since the 1960s, are outdated, expensive, low-quality, and labor intensive. FIG. 1 depicts a typical large-area photomultiplier tube (LAPMT) based on vacuum tube technology and dynode electron multipliers that are essentially hand-made, expensive and very problematic to produce in sufficiently large quantities. The structures of these existing devices suffer from numerous drawbacks, many of which arise from their "ship-in-a-bottle" type of design, in which all the elements of the device are retained, interconnected, and supported within a single enveloping glass-tube housing.

The LAPMT shown in FIG. 1 has a configuration whose manufacture is intrinsically labor-intensive, with the glass bulb and dynode column each accounting for about one half of the manufactured cost of an LAPMT. The complexity and cost of the bulb portion is significantly influenced by the necessity of having a long dynode column leading into the spherical bulb portion. The configuration of existing devices requires that the bulb and the dynode column are both created in a substantially handmade manufacturing process.

In addition, it should be noted that an LAPMT has a closed topology, and the photocathode formation process actually takes place within an assembled LAPMT. In this way every LAPMT can be considered in some manner to be its own "factory" whose "tools" for creating the photocathode remain in the LAPMT forever.

One class of LAPMT devices called Hybrid Photon Diodes replaces the dynode chain in a PMT with a semiconductor electron detector, typically with an ordinary Avalanche Photo Diode (APD) placed within the vacuum enclosure. HPDs are very expensive to produce for a number of reasons. First, there is the high cost of the Avalanche Photo Diodes themselves, which cannot merely comprise a multi-cell Geiger-mode APD, because of their large dead area (approximately 50%) for direct photoelectron detection. For application in HPDs, ordinary APDs which have no dead area, however, require that the passivation surface layer be removed. Second, there is a need for high voltage supplies to an ordinary APD. Third, there is a need to avoid contamination of ordinary APDs with alkali metals used for photocathode fabrication. The direct use of ordinary APDs is thus fraught with numerous drawbacks, while they are also very sensitive to even slight amounts of light overexposure, and in other ways are too fragile for a number of applications. Still further, an APD provides only a very low gain (thousands), with an output signal that requires careful shielding and significant amplification using expensive preamplifiers.

Furthermore, existing LAPMT device solutions are subject to a number of serious performance problems, including but not limited to the following: (1) very low photoelectron collection efficiency, such as only approximately 70%, which is often unlisted on manufacturer data sheets; (2) modest quantum efficiency; (3) non-uniform quantum efficiency; (4) high sensitivity to geomagnetic fields; (5) complicated and expensive mounting options; (6) highly fragile packaging which was dramatically demonstrated in the Super Kamiokande disaster; and (7) lack of single-photon resolution.

Major manufacturers of PMTs have either discontinued their production, or appear to be considering doing so. As a result, the fields of astroparticle and particle physics, as well as many other applications could become "stranded" without availability of this core detector component. The available devices, such as silicon detectors, for instance like the avalanche photo diodes (APDs) utilized for the readout of crystals in the Compact Muon Solenoid (CMS) experiment at the Large Hadron Collider (LHC) at CERN in Geneva, are considered too small and costly for use in experiments requiring a very large sensitive area.

Accordingly, a need exists for a photosensitive device which approaches that of an ideal detector without the attendant implementation complexities and costs. The present invention overcomes these issues and provides an inexpensive and scalable photosensor element which can be readily mass-produced.

BRIEF SUMMARY OF THE INVENTION

The present invention is a novel vacuum photosensor device, which is referred to herein as an "ABALONE" photosensor, and the method for its production. By way of example, and not of limitation, in one embodiment a photon detector converts photons to photoelectrons at a photocathode layer which is configured in a first portion of the device for concentrating the electrons through a field lensing effect onto a readout. Electron activity can be determined with a detector in a second portion of the device which registers activity at the readout. Active elements are thus not required in the high vacuum portion of the photosensor device.

In one embodiment, a concave transparent window of a first housing portion, such as a hemispherically shaped window in a vacuum housing, is adapted with a photocathode layer. A base plate and a second portion of the housing are preferably adapted with electrode rings and a cathode, respectively, which interoperate with the photocathode layer in the first portion of the housing to concentrate electrons on the readout located on the base plate.

In one embodiment, two conductive seals are utilized as the only electrical connections into the vacuum housing portion for establishing high voltage (HV) connections (e.g., HV and ground) for the cathode and anode. In one embodiment, a vacuum seal is provided through an oxide-free indium sealing technique.

The individual elements (pixels) of the present invention may be seamlessly combined into a flat-panel array that provides for light detection without dead areas which fail to collect and register light between the sensing pixels.

In one embodiment, a vacuum-enclosing portion of the device comprises three inexpensive, mass-produced glass elements: a vacuum housing (e.g., hemisphere), a base plate and a central electron readout element. This allows for scalable mass production with low investment. When constructed of ultrapure quartz, the inventive photosensor provides an unprecedented low level of radioactivity. In one embodiment, a thin-film deposited sealing means retains the ultra-high vacuum while also serving as high voltage throughputs, eliminating any need for electrodes or solid metallic feedthroughs.

The present invention provides a readily fabricated, highly sensitive, universal and durable photosensor solution which is scalable as it does not rely on the production of large monolithic sensor panels. The present invention also provides for scalable industrial mass production which is achievable at a fraction of the cost required when producing classical photomultipliers, classical hybrid photon diodes (HPD), as well as large area monolithic flat-panel devices, including those described in U.S. Pat. No. 6,674,063 which is incorporated herein by reference in its entirety, and those described in PCT International Publication No. WO 2007/098493 A2 published on Aug. 30, 2007 which is incorporated herein by reference in its entirety. It will be appreciated that the cost of facilities for fabricating a UHV device increases steeply as a function of physical size.

Accordingly, an aspect of the invention is a vacuum photosensor device which provides high collection rate and accurate measurements within a robust structure which can be readily mass produced.

Another aspect of the invention is a vacuum photosensor device which converts photons to photoelectrons which are registered by the device.

Another aspect of the invention is a vacuum photosensor device in which the vacuum chamber portion is readily manufactured and contains only a photoelectron readout and reflective rings.

Another aspect of the invention is a vacuum photosensor device in which the first chamber is a transparent hemisphere having a photocathode on its inner surface and an anode at a readout.

Another aspect of the invention is a vacuum photosensor device in which a first hemispherical chamber operates in combination with a second hemispherical chamber to create a field for directing photoelectrons to the photoelectron readout.

Another aspect of the invention is a vacuum photosensor device in which a base plate attached to a vacuum housing portion has a through window for coupling light beyond the vacuum interior.

Another aspect of the invention is a vacuum photosensor device which utilizes a hermetic seal between the first chamber and a base plate between which is retained an ultra-high vacuum.

Another aspect of the invention is a vacuum photosensor device in which conductive hermetic seals are utilized as the only electrical connections into the ultra-high vacuum housing.

Another aspect of the invention is a vacuum photosensor device whose exterior is retained at a fixed potential, and which requires only one other potential for operation.

Another aspect of the invention is a vacuum photosensor device which concentrates photon activity striking the photocathode onto a sensing area (readout) which is multiple (e.g., three to four) orders of magnitude smaller.

Another aspect of the invention is a vacuum photosensor device in which photoelectrons strike a scintillator on the vacuum side of the device and whose light passes through a transparent region to be registered by a detector on the non-vacuum side of the device.

Another aspect of the invention is a vacuum photosensor device in which the base plate, to which are attached the sides (hemispheres) of the device, contain electrically conductive, residual gas absorbing, and light-reflective rings.

Another aspect of the invention is a vacuum photosensor device which does not require high voltage feedthroughs and which minimizes the use of materials, as well as the number and duration of production processing steps.

Another aspect of the invention is a vacuum photosensor device which can utilize a Geiger-mode avalanche photo diode, Si-PMT, avalanche photo diode, or other light detection device including position-sensitive light detection device Another aspect of the invention is a vacuum photosensor device which can sense photon activity utilizing a semiconductor detector, avalanche photo diode, or channeltron for secondary light sensing, or perform direct sensing with microchannel plates or compact dynodes.

Another aspect of the invention is a vacuum photosensor device which incorporates a high voltage converter on the non-vacuum interior of the housing.

Another aspect of the invention is a vacuum photosensor device in which the housing can be adapted to a number of different shapes depending on the application and environment.

A still further aspect of the invention is a vacuum photosensor device which is robust mechanically, electrically, and optically.

Further aspects of the invention will be brought out in the following portions of the specification, wherein the detailed description is for the purpose of fully disclosing preferred embodiments of the invention without placing limitations thereon.

BRIEF DESCRIPTION OF THE SEVERAL VIEWS OF THE DRAWING(S)

The invention will be more fully understood by reference to the following drawings which are for illustrative purposes only:

DETAILED DESCRIPTION OF THE INVENTION

1. Introduction

The present invention is a photosensor, referred to herein as the "ABALONE" photosensor (named in view of its shape), which offers superior performance to existing photosensors.

Figure 1:
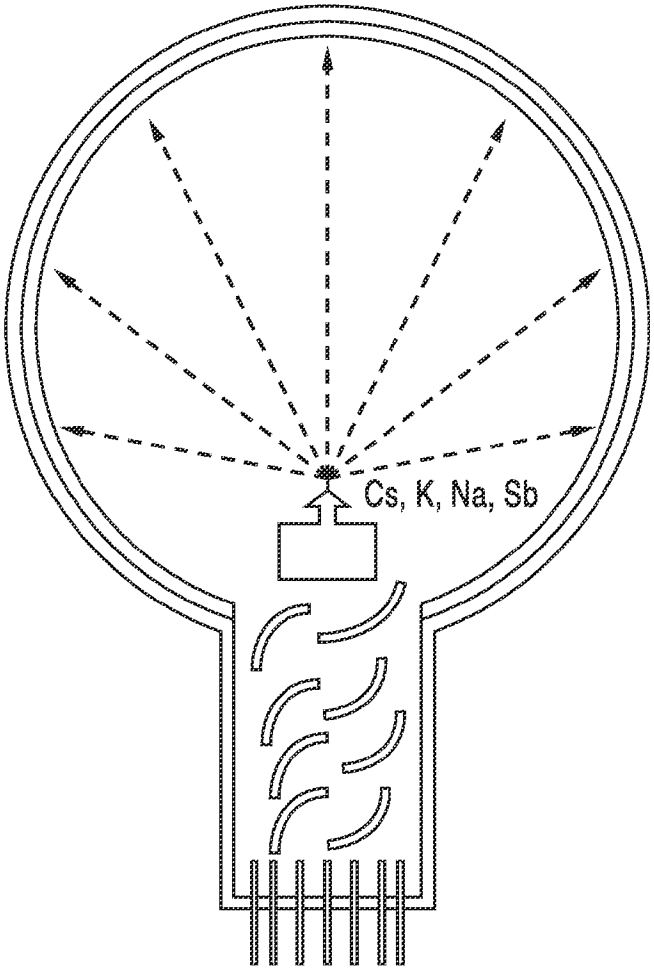
FIG. 1 (Prior Art)
FIG. 1 is a schematic of a conventional large area photomultiplier tube.

In contrast to conventional LAMPTs, such as shown in FIG. 1, the present invention, does not require either the hand blown glass bulb or the dynode column while it provides improved sensing in a structure with increased tolerances to its environment, including pressure, heat, light, vibration, and magnetic fields.

2. Sealing Means

Figure 2:
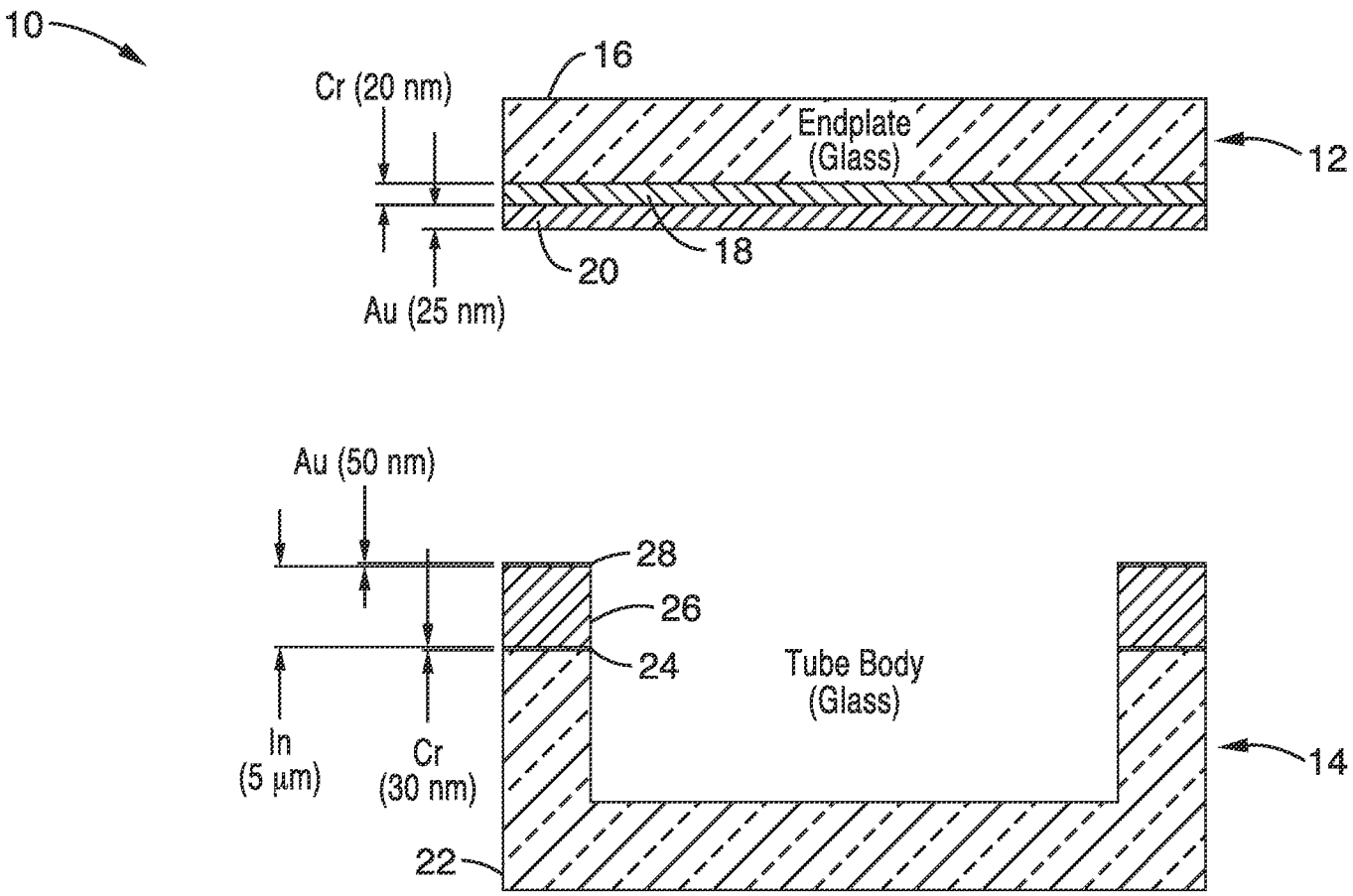
FIG. 2 is a cross-section view of tube body sealing mechanism according to an element of the present invention.

Referring first to FIG. 2, an embodiment 10 of an oxide-free sealing means for an ABALONE photosensor device according to the present invention is shown. In FIG. 2, a glass endplate 12 is shown configured for being hermetically sealed to a tube body 14. Layers of material are deposited on both portions to be joined, specifically, the endplate glass 12 of a material 16 and tube body 14 of a material 22 In preparation for sealing. A layer of Chromium (Cr) 18, for example about 20 nm thick, is overlaid with Gold (Au) 20, for example of 25 nm thick, on one element with the other elements being overlaid with a layer of Chromium (Cr) 24 of about 30 nm, Indium (In) 26 of about 5 um and Gold (Au) 28 of about 50 nm. In response to heat the Indium reacts with the Gold to form a Gold-Indium interface.

The primary role of the Chromium film in the sealing means is to establish a chemical contact with glass or quartz. Chromium breaks the chemical bond between Silicon and Oxygen in these materials and attaches itself to both. Indium is a soft metal and has a low melting point, but it does not wet glass. A very small amount of Gold dramatically reduces the surface tension of Indium over Chromium-coated glass and provides a uniform sealing layer. Once the temperature is raised to the melting point of Indium, Indium dissolves Gold and the two form an alloy that wets and adheres to sealing surfaces. Once the temperature is reduced, this alloy solidifies and creates a very strong glass-glass bond. Destructive tests have been performed by the inventive lab that show that this bond survives even under forces in which the surrounding glass is crushed.

Multiple embodiments of the invention apply the vacuum seal in two areas: (1) sealing the small dielectric photoelectron readout element to the base plate, and (2) sealing the transparent window to the base plate. This vacuum seal has multiple functions in the present invention which extend beyond hermetically sealing a vacuum enclosure. This seal is implemented as a thin metallic layer to serve in providing electrical connections into the two sealed areas, from the non-vacuum side of the device to the vacuum-side. These electrical connections provide the electrical potentials needed for electron acceleration and focusing. In addition, being composed of a thin metallic layer of a very high reflectivity, the vacuum seal of the photoelectron readout element to the base plate acts as an optical mirror which prevents the loss of secondary photons, created upon the impact of a photoelectron in a scintillator on the vacuum side of the photoelectron readout element, on their way from the scintillator to the readout of those secondary photons (preferably a Geiger-mode APD), which is brought to an optical contact with the surface of the photoelectron readout element on its non-vacuum side. The vacuum seal of the photoelectron readout element to the base plate is preferably made thick enough to be opaque to the secondary photons emerging from the scintillator, which prevents those photons from leaving the photoelectron readout element in any direction except into the secondary photon readout (such as G-APD) and thus prevents optical feedback, such as from any of the secondary photons reaching the photocathode. Still further, the vacuum seal between the window plate and the back plate, being composed of the thin metallic layer of a very high reflectivity acts as an optical mirror which reflects photons that have missed the photocathode area and fell into the vacuum sealing area, sometimes towards the photocathode, or sometimes to the outside dielectric window surface which may in specific embodiments also be reflective and thus in some cases increase the chances of the photon reaching the photocathode.

Figure 3:
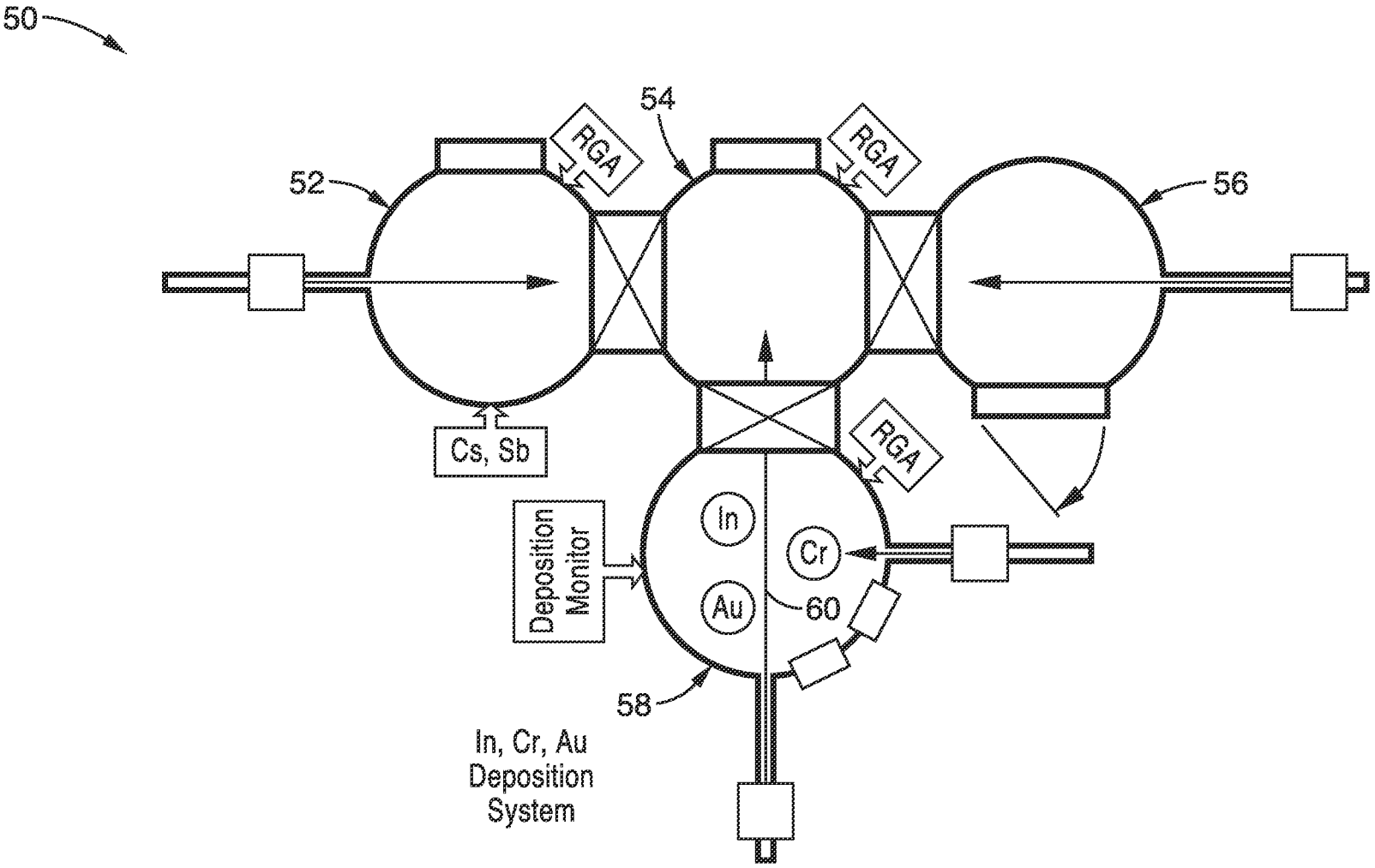
FIG. 3 is a schematic of an ultra-high vacuum (UHV) facility according to one element of the present invention utilized in prototype development toward proving key invention principles.

FIG. 3 illustrates an uninterrupted vacuum production line embodiment 50, exemplified as the UHV (ultra high vacuum) transfer facility which the inventors have developed at the University of California at Davis. This device is utilized for photocathode deposition and sealing the concave transparent housing to the base plate while retaining an ultrahigh vacuum. The production line 50 is shown with four ultrahigh vacuum chambers 52, 54, 56 and 58, with base pressure lower than $5\times10^{-10}$ Torr, for fabricating the devices. Each chamber, for example, can be pumped with turbomolecular and ion pumps, with the vacuum quality controlled by quadrapole mass spectrometers. Prototype components travel from one chamber to another for appropriate processing, and finally meet in the central chamber 54 for hermetic sealing.

A preferred factory will have three separate and specialized lines of chambers, one for each glass component. Those lines would meet in a pair of sealing chambers. The system is complex as each chamber needs to handle different elements, with different geometry and functionality, although the size of the chambers and processing equipment is kept small in view of the scalable nature of the devices, in that they are not manufactured in large monolithic arrays.

3. Light Amplifier

Rather than utilize the conventional photoelectron sensing, such as by utilizing dynodes, channeltrons, channel plates or ordinary avalanche photodiodes (APD), the ABALONE devices incorporate a light amplifier, or concentrator. The light amplifier is defined in this context as a vacuum device that converts the energy of an accelerated photoelectron into secondary light from a scintillator, and that secondary light is then transmitted outside the vacuum enclosure for detection by a sensor, such as a Geiger-mode APD.

The light amplifier concept draws its strength from the unique features of modern, readily mass-produced multi-cell G-APDs, while at the same time it diminishes drawbacks of the G-APD that present serious limitations on the usefulness for direct detection of single photons at room temperature. The advantages of G-APDs include low cost for a given sense area, low bias voltage (only around 70 Volts), complete safety against exposure to ambient light (G-APD simply runs in saturation), single-photon sensitivity, single-photon resolution up to dozens of photons, availability of large production quantities and ability to tailor these products to the application. The drawbacks of G-APDs include low photon detection efficiency (compared to ordinary APDs), high frequency and level of noise at room temperature (on the order of a single-photon signal), emission and internal detection of secondary photons within the device.

A light amplifier surpasses the above drawbacks in the following way. The low photon detection efficiency is not critical because in a light amplifier a G-APD detects a multitude of secondary photons (for example 50) originating from a single initial photon. The internal noise on the order of a single photon is also surpassed by the light amplifier because a multitude of secondary photons is detected by a G-APD for each original photon converted in the photocathode so the corresponding signal is much higher than the noise level. Regarding the creation of secondary photons within the G-APD, this effect is probabilistic and the significance is progressively less as the number of incoming photons increases, which is again the case in a light amplifier with the large number of secondary photons per each primary single photon.

Light amplification as described herein for each of the embodiments can be generally applied to other photosensor configurations, including those fabricated in array configurations. It should be appreciated that in the ABALONE device the light amplifier forms a synergy together with other key elements, such as use of a minimum number of mass-producible elements that constitute the vacuum part of the device, and electron optics that requires only a single high voltage (HV) supply (e.g., high voltage potential and ground), and the use of an oxide-free vacuum seal that allows glass-to-glass vacuum sealing with a thin sandwich of metals that simultaneously act as the only high voltage supplies into the vacuum enclosure and optical reflectors. Specifically, the light amplification within the present invention allows placing the electronic readout outside the vacuum enclosure, which presents a critical simplification in the design and the manufacture of the ABALONE device. It will be appreciated that the manufacture of the vacuum part of the device in general presents the most challenging and expensive part, and the described synergy of the ABALONE device introduces crucial simplifications compared to prior art.

Additionally, embodiments of the invention preferably utilize a new generation of fast and efficient scintillators for the photoelectron readout. A new generation of rapidly improving high-quality, low-cost Geiger-mode Avalanche Photodiodes (G-APDs) are preferably utilized as an ideal secondary light readout element. It will be appreciated that other light sensors may be utilized for the readout of secondary light from the scintillator. It should also be appreciated that use of a direct photoelectron readout may be preferable in some applications.

Figure 4C:
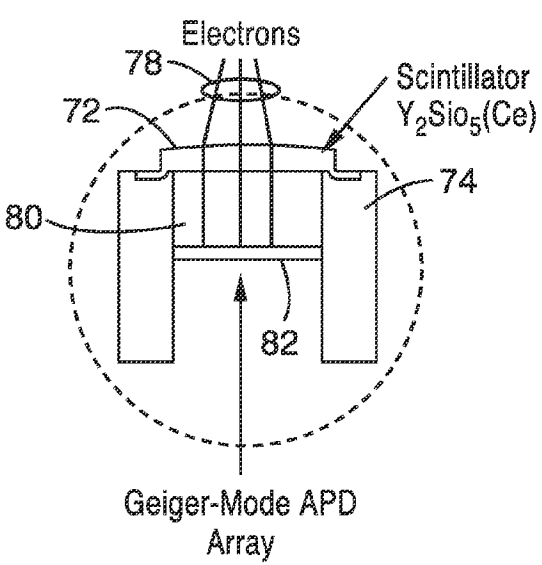
FIG. 4A through FIG. 4C are schematics illustrating light amplification according to an element of the present invention.
Figure 4B:
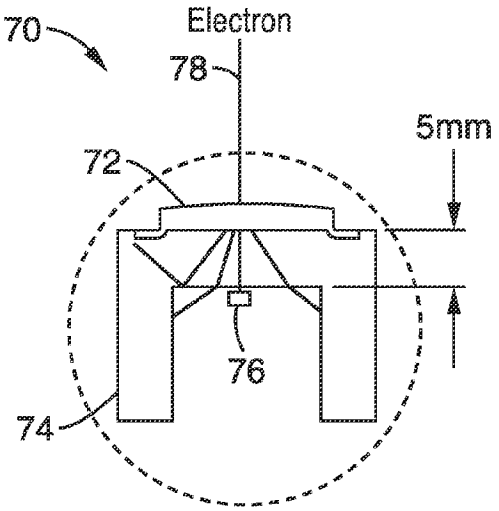
Figure 4A:
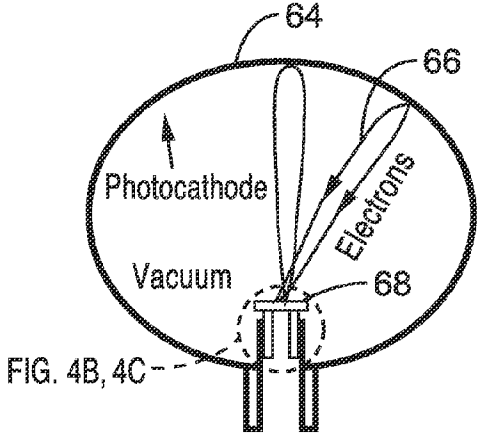

FIG. 4A through FIG. 4C illustrate the light amplifier concept, in which photoelectrons 66 originating from a photocathode 64 are accelerated within the vacuum tube shown in FIG. 4A to an energy of approximately 15 to 35 keV, and which are focused upon a small scintillator surface 68. The slightly amplified light signal from the scintillator is then detected by a detector, such as a point-source light sensor or an imaging light sensor. With the use of proper optics and an imaging detector, the present invention allows determining position information for the arriving photoelectron. FIG. 4B depicts the case of registering only the presence of a photon in response to secondary light from the scintillator being detected by a detector 76, while in FIG. 4C the relative arrival position of the photoelectrons on the scintillator are retained in their relative position through a fiber plate 80 to a sensor array 82 (e.g., Geiger-mode APD) which registers both presence and location of the photon events.

In either case, the light is amplified (concentrated) in the ultra-high vacuum side of the device and directed to a detector within the enclosure portion which need not be held to an ultra-high vacuum. Certain applications may benefit from the use of a fiber plate coupling 80, or similar imaging element which preserves image configuration, as represented by way of example and not limitation in FIG. 4C.

In FIG. 4B an integrated structure of vertical tube 74 is shown upon which is a scintillator surface 72. Scintillation light from electron 78 is directed to detector 76. FIG. 4C depicts a similar configuration with vertical tube 74 coupled to a fiber plate coupling 80, over which is a scintillator surface 72, whereby scintillator light from electrons 78 striking scintillator 72 is directed through fiber plate coupling 80 to a detector array 82.

Considering the use of a Geiger-mode APD 76 as the detector, it is placed outside the vacuum enclosure, on the other side of window 74. For applications that would benefit from information on the position of the photon strike on the vacuum enclosure 64, the simple window 76 may be replaced with a fiber plate window 80 that preserves the image configuration from the scintillator to an array of G-APDs or to some other position-sensitive light detector as shown in FIG. 4B. The imaging information is projected from the photocathode by orderly focusing of the photoelectrons onto the scintillator surface.

Prototypes have been produced and tested without a fiber plate coupling as shown in FIG. 4B, and those tests have confirmed the usefulness of the light amplifier concept based on a G-APD secondary light readout despite the mismatch in the diameters of the 1-inch diameter scintillator and the 1 mm diameter G-APD. So although FIG. 4B depicts a mismatch between scintillator and sensor, it will be appreciated that improved performance is provided by matching the sizes of the scintillator with the detector so that all light from the scintillator is received by the detector. In addition, it should be appreciated that additional optics can be included to direct the scintillator light to the sensor without departing from the teachings of the present invention.

The light amplifier readout of ABALONE comprises an optically matched coupling between the scintillator and the G-APD, where the area of the G-APD is preferably larger than the area of the scintillator, while the optical coupling is optimized for efficient light transmission, including but not limited to the use of highly reflective surfaces on the sides of the windowlet, rectangular windowlet shape or at least rectangular shape of the windowlet surface in contact with G-APD, proper matching of the windowlet dielectric material in terms of refractive index, proper choice of optical glue between the windowlet and the G-APD, and so forth.

It should be appreciated, that in view of its strong electron focusing, ABALONE requires only a very small scintillator (e.g., approximately 1.5 mm for a 5 inch device), and a single-pixel, small G-APD (e.g., less than approximately 3 mm) for its readout.

The present invention has been developed with the goal of industrial mass-production. For example, the interior vacuum is retained within a concave dome (e.g., hemispherical) which can be formed by industrial glass processing, such as in a molding process. The glass may be of different types depending on the application, such as using Borosilicate glass, quartz crystal, fused silica or similar.

Another key object of the ABALONE project is to support a continuous assembly process which is made possible by the open architecture. Once domes, plates and windowlets are manufactured, they can be readily processed (e.g., cleaning, thin film deposition, sealing) in a continuous transfer line, such as within the UHV Transfer Facility.

4. Photosensor Embodiments

Various embodiments of an ABALONE photosensor according to the present invention generally comprise three inexpensive, mass-produced elements processed and sealed together using the oxide-free thin film sealing means previously described, preferably within a continuous UHV production line.

Referring now to FIG. 5 through FIG. 9, an embodiment 90 of an open architecture vacuum photosensor device according to the present invention is illustrated. The vacuum seal is facilitated by the oxide-free Indium sealing means previously described, which can be performed simply and rapidly. In addition, the resultant two thin-film seals act together as the only necessary high voltage throughputs to the device. It will be appreciated that no electrode feedthroughs are necessary, which simplifies the production process and utility of the inventive ABALONE photosensor devices.

Figure 5:
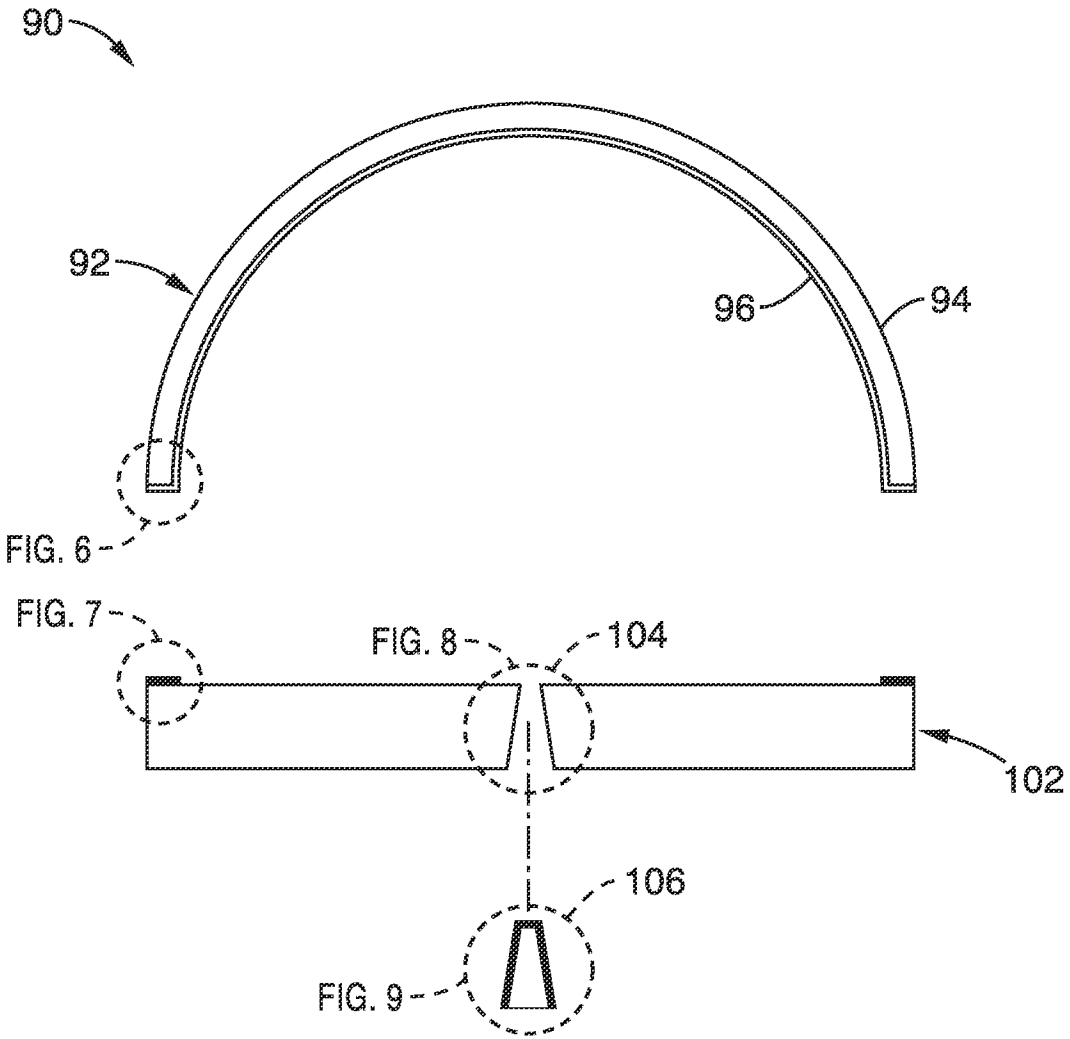
FIG. 5 is an exploded view of a hemispherical dome configured for attachment to a base plate with readout according to an element of the present invention.
Figure 7:
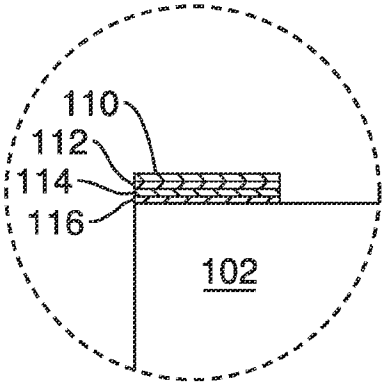
FIG. 7 is a detail view of the seal layer on the perimeter of the base plate of FIG. 5 according to an element of the present invention.

The embodiment shown in FIG. 5 through FIG. 9 comprises a vacuum housing portion, herein concave shaped as a first housing (hemisphere) 92 of optically transparent dielectric material 94 having a conductive layer 96 as a photocathode and shown hermetically sealed to a base plate 102 having a through hole 104 into which a readout 106 is sealed. FIG. 5 depicts the hemisphere, base plate and readout in an exploded view. An electron readout is sealed within the first housing between the base plate and transparent dielectric material.

(1) Dome with Base Plate.

Figure 9:
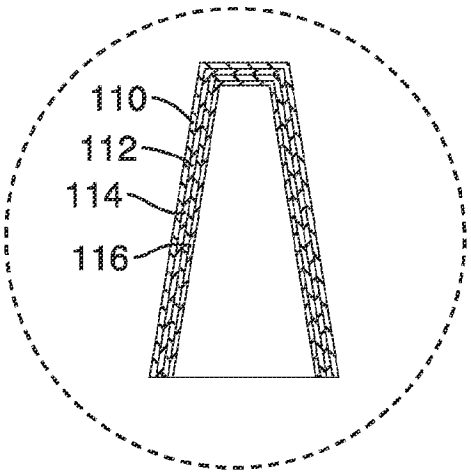
FIG. 9 is a detail view of the exterior layers of the readout for insertion within the through hole of the base plate of FIG. 5, showing material disposed thereon for sealing according to an element of the present invention.
Figure 6:
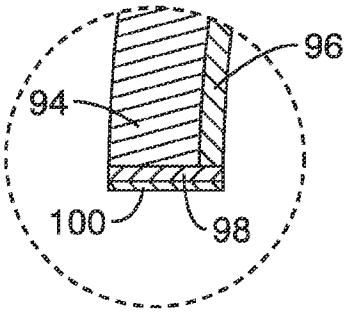
FIG. 6 is a detail view of the perimeter of the hemispherical dome of FIG. 5, showing the material of the cathode disposed thereon according to an element of the present invention.
Figure 8:
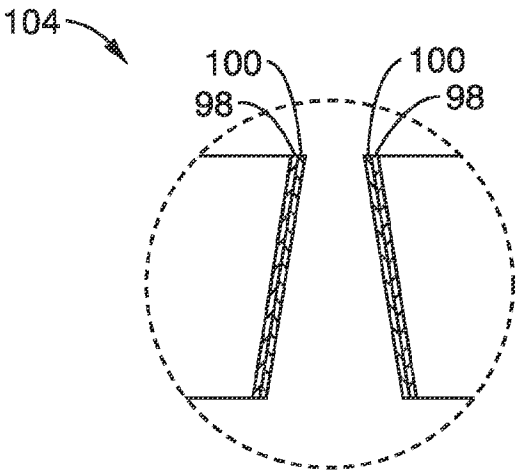
FIG. 8 is a detail view of the interior of the through hole in the base plate of FIG. 5, showing material disposed therein for sealing according to an element of the present invention.

A thin-film photocathode layer 96 is deposited in the cavity of a transparent dome 92 (e.g., preferably comprising glass or quartz 94). The perimeter of the dome 92 in FIG. 6 and edges of a through hole 104 in FIG. 8 are shown with a Chromium 98 and Gold interface 100 over the transparent material 94. A base plate 102 in FIG. 7 and transparent conical plug 106 in FIG. 9 are shown with seal layers Indium and Gold ($AuIn_2$) 110, Indium (In) 112, Gold (Au) 114 and Chromium (Cr) 116 over the base material. It will be recognized by one of ordinary skill in the art that certain other metals may be utilized within these sealing layers without departing from the teachings of the present invention.

In at least one ABALONE embodiment ultrathin layers are disposed on the base material forming concentric rings on the vacuum side (shown in a later figure), which act simultaneously as: (a) a system of floating electrodes, (b) a reflector for photons that were not converted in the photocathode in their first pass, whereby it returns those photons back to the photocathode for another pass, and (c) a nonevaporable vacuum pumping getter material (NEG).

(2) Seals.

A conical plug (described above), or cover platelet (shown in FIG. 13), each provide a vacuum sealing configuration which comprises (a) a thin-film vacuum sealing material, (b) a thin-film scintillator layer, covered by a thin-film metallic layer (e.g., aluminum layer), such as seen in FIG. 4A through FIG. 4C. (c) The body of the plug/platelet, acting as a light guide to guide the light from the scintillator on the vacuum side to reach the detector, such as a Geiger-mode avalanche photodiode or other highly sensitive photo sensor, which is optically coupled outside the vacuum enclosure.

(3) Backing Structure.

Figure 12:
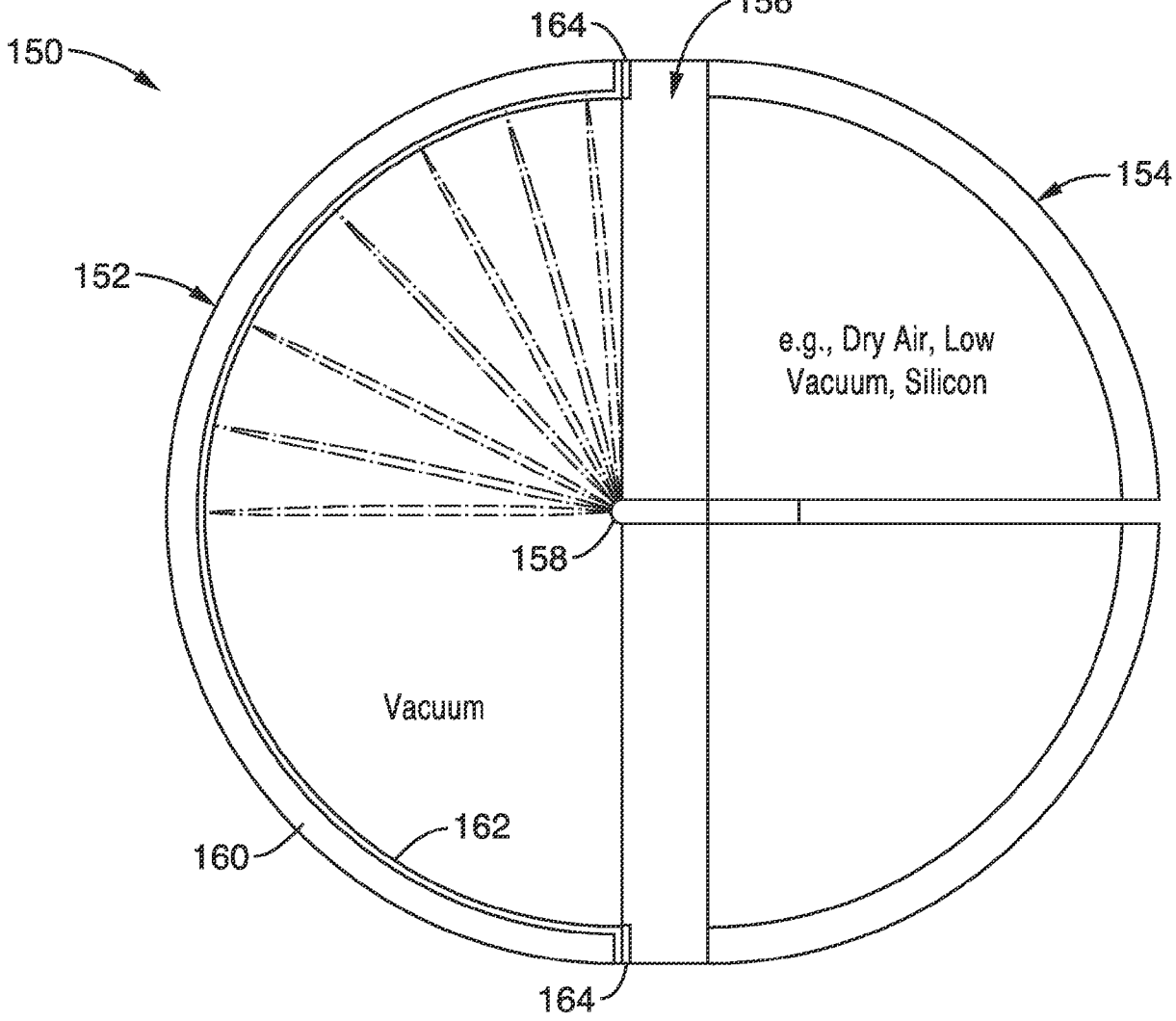
FIG. 12 is a schematic of a vacuum photodetector showing a backing hemisphere coupled to an evacuated sensing hemisphere according to an element of the present invention.
Figure 13:
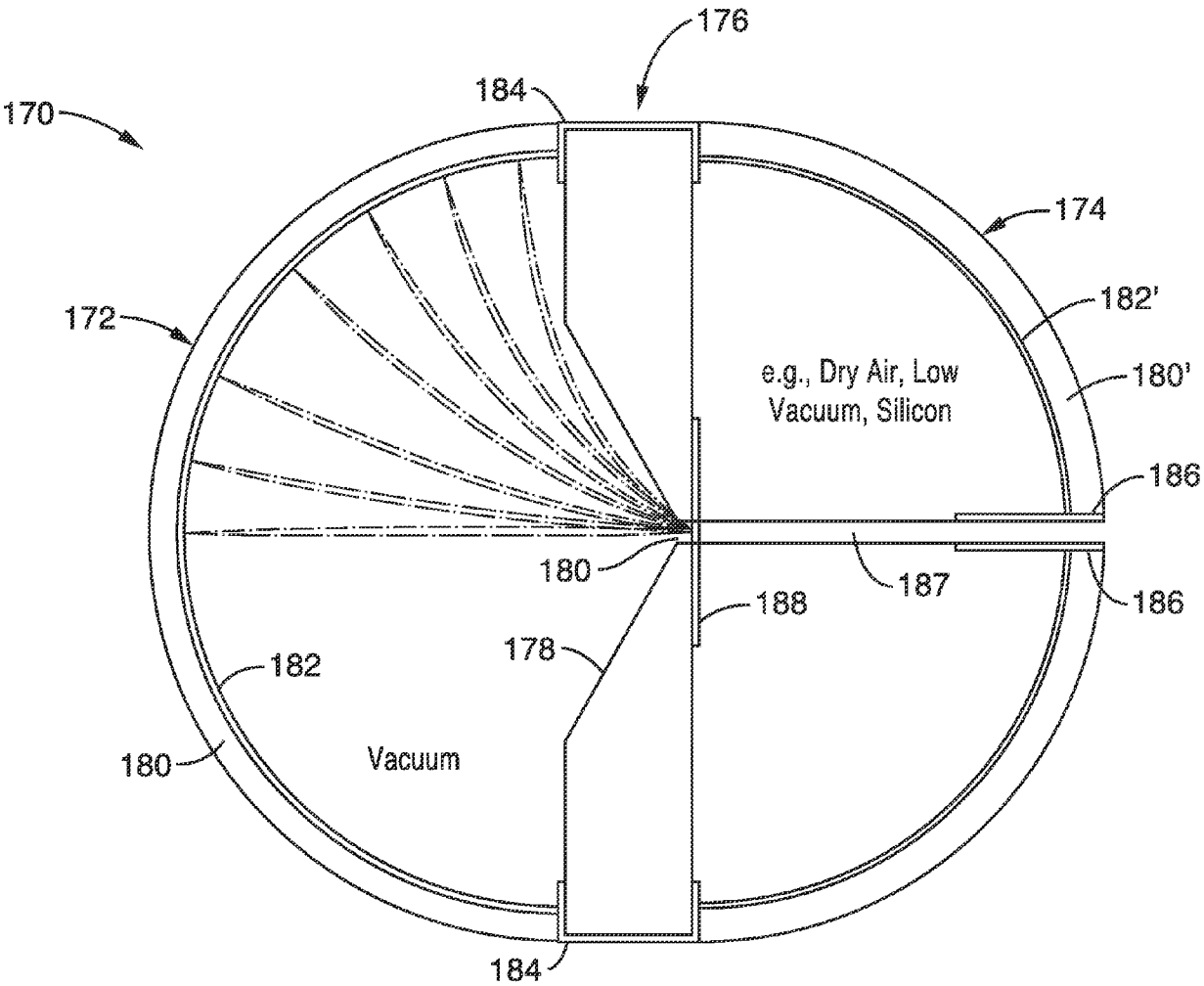
FIG. 13 is a schematic of a vacuum photodetector having a recessed anode according to an element of the present invention.

A housing, such as a backing hemisphere or other concave shape, is attached (e.g., glued, for instance with epoxy) outside the evacuated portion of the device, to the back of a sealed ABALONE hemisphere assembly, (refer to FIG. 12 and FIG. 13). This attachment of the backing structure is preferably performed at the end of the fabrication process after the high-vacuum component elements have been assembled. This backing hemisphere provides: (a) electrical insulation, wherein ground potential encapsulates ABALONE; (b) space for the miniature low-current HV supply and/or the G-APD signal output, and (c) enhances mechanical robustness, particularly for high-pressure environments.

Unlike previous vacuum photosensors, ABALONE does not require any solid (structural) metal electrodes or electrical feedthroughs. The electrodes of ABALONE are fabricated from only thin metal film layers sparingly deposited on the three components. If fabricated from ultrapure quartz instead of glass, ABALONE devices can provide unprecedented low levels of intrinsic radioactivity, thus opening entirely new avenues in the search for dark matter, neutrinoless double beta decay and other low-activity applications in research and defense.

Unlike previous sensor devices, ABALONE is suitable for pixel-by-pixel production in a less expensive manner in view of its very narrow size requirements within a UHV mass-production facility. These devices, however, are particularly well-suited (e.g., hexagonal dome configuration described later) for close packaging into a homogeneous flat panel device which substantially eliminates collection dead area.

The ABALONE photosensor embodiments provide a synergistic solution determined from research and development with the inventors laboratory within a particularly simple innovative device platform for electron optics.

The flat-panel sensor can be produced in any desired manner, which yields the desired optical characteristics. For example, two preferred manufacturing methods for the production of the individual pixels that are described as follows. (1) Compression-molded glass techniques can be utilized, such as according to either state of the art compression molding techniques which utilize relatively expensive molds, or using older techniques, such as Rochester/Carnival glass compression molding methods which use relatively inexpensive molds within a slower and more expensive process. (2) Cutting techniques can be alternatively utilized, such as monolithic CNC ground quartz, which is a perfect technique during research and development and can be performed on ultra-pure quartz material.

One of the most important elements of the ABALONE device is a specific electron lensing configuration that supports implementation of the other inventive elements. It has been a particular challenge to concentrate photoelectrons from a large hemispherical photocathode surface to a very small area in the evacuated region:

It will be appreciated that it is an easier and more natural task to focus electrons in an imaging fashion, from a point on the photocathode surface, to a point on the focal surface. However, focusing of electrons from an entire sphere or hemisphere in a truly point-like fashion is not feasible. Yet in the present invention, by a novel configuration of the electric field, it is possible to achieve a high level of concentration of the photoelectrons without incurring additional flight distance, and/or requiring additional electrodes within the vacuum enclosure.

Concentrating photoelectrons in the ABALONE device does not require the use of numerous electrodes in and around, the vacuum cavity to achieve this goal. The ABALONE electron lens has a number of important aspects, including that it only requires a single high voltage and a ground, the enclosure (e.g., hemispherical photocathode) being preferably retained at ground potential.

Figure 10:
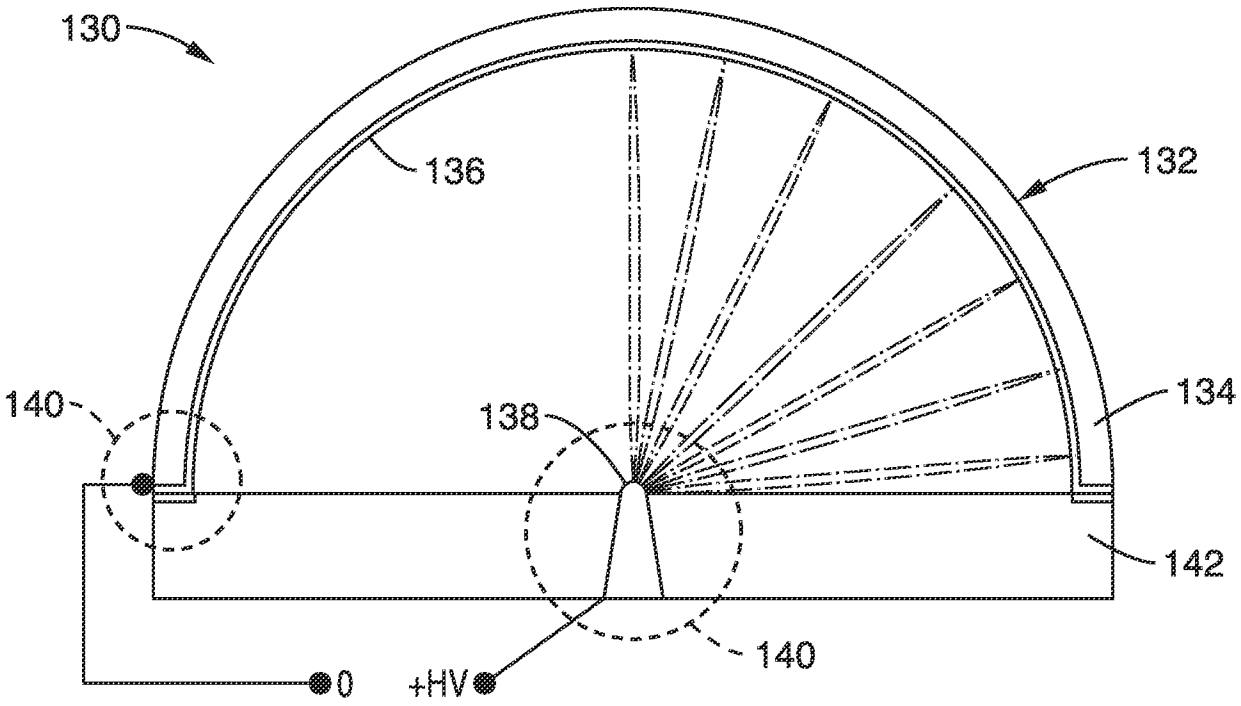
FIG. 10 is a schematic of a vacuum photodetector showing high voltage application between cathode and anode along with photoelectron paths, according to an element of the present invention.
Figure 16:
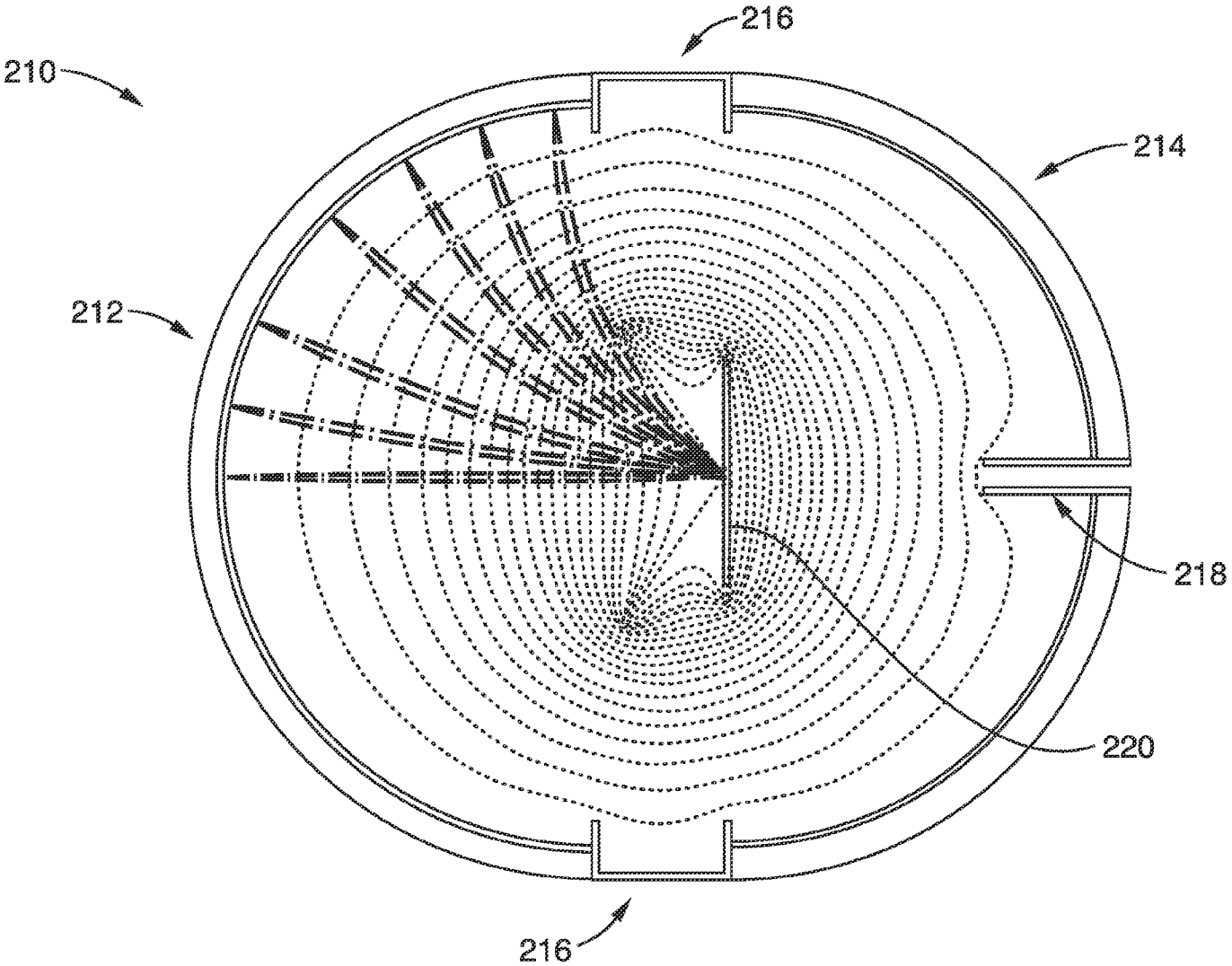
FIG. 16 is a schematic of a vacuum photodetector, showing equipotential surfaces, according to an element of the present invention.
Figure 17:
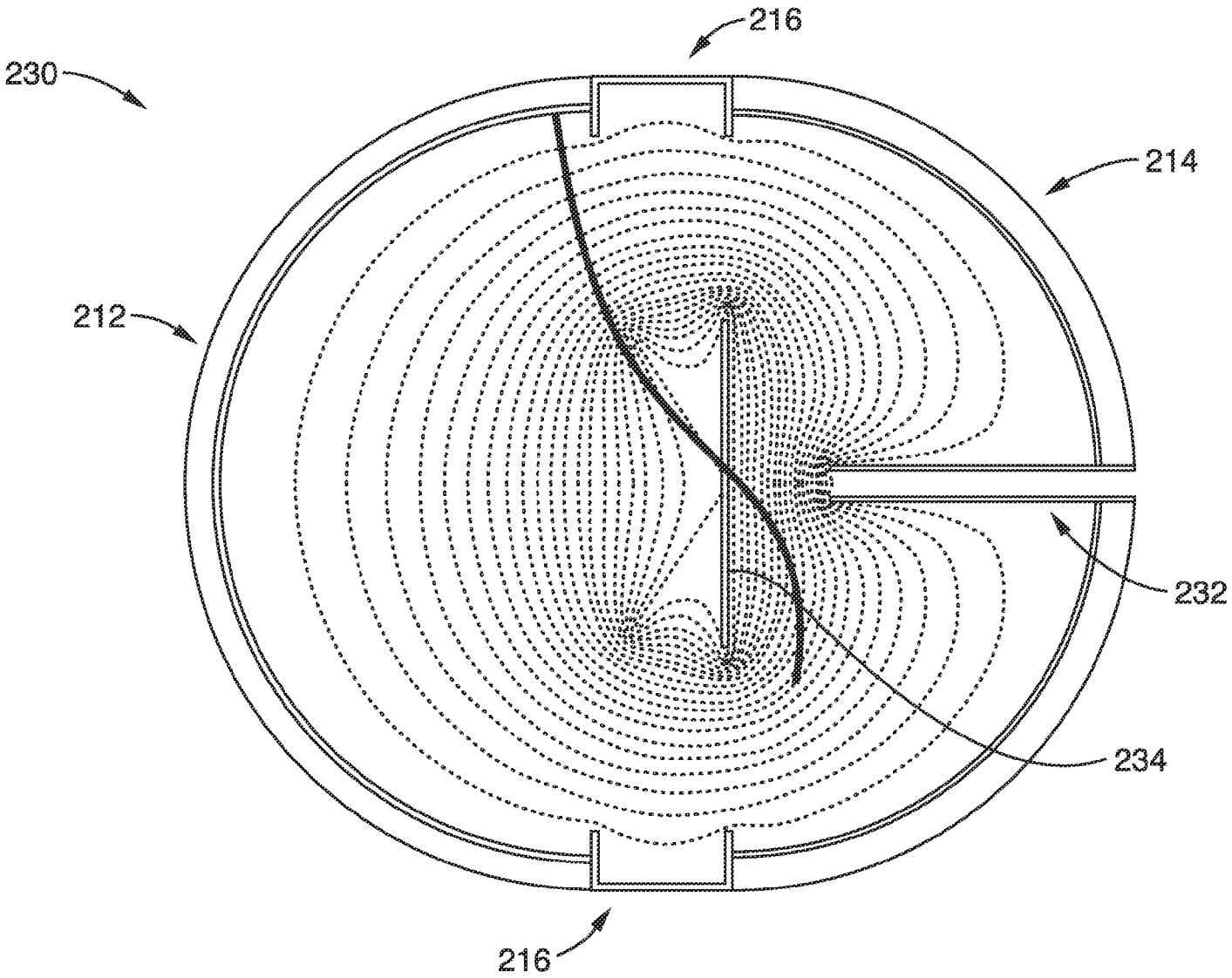
FIG. 17 is a schematic of a vacuum photodetector having an enlarged electrode in a back hemisphere and showing equipotential surfaces according to an element of the present invention.
Figure 18:
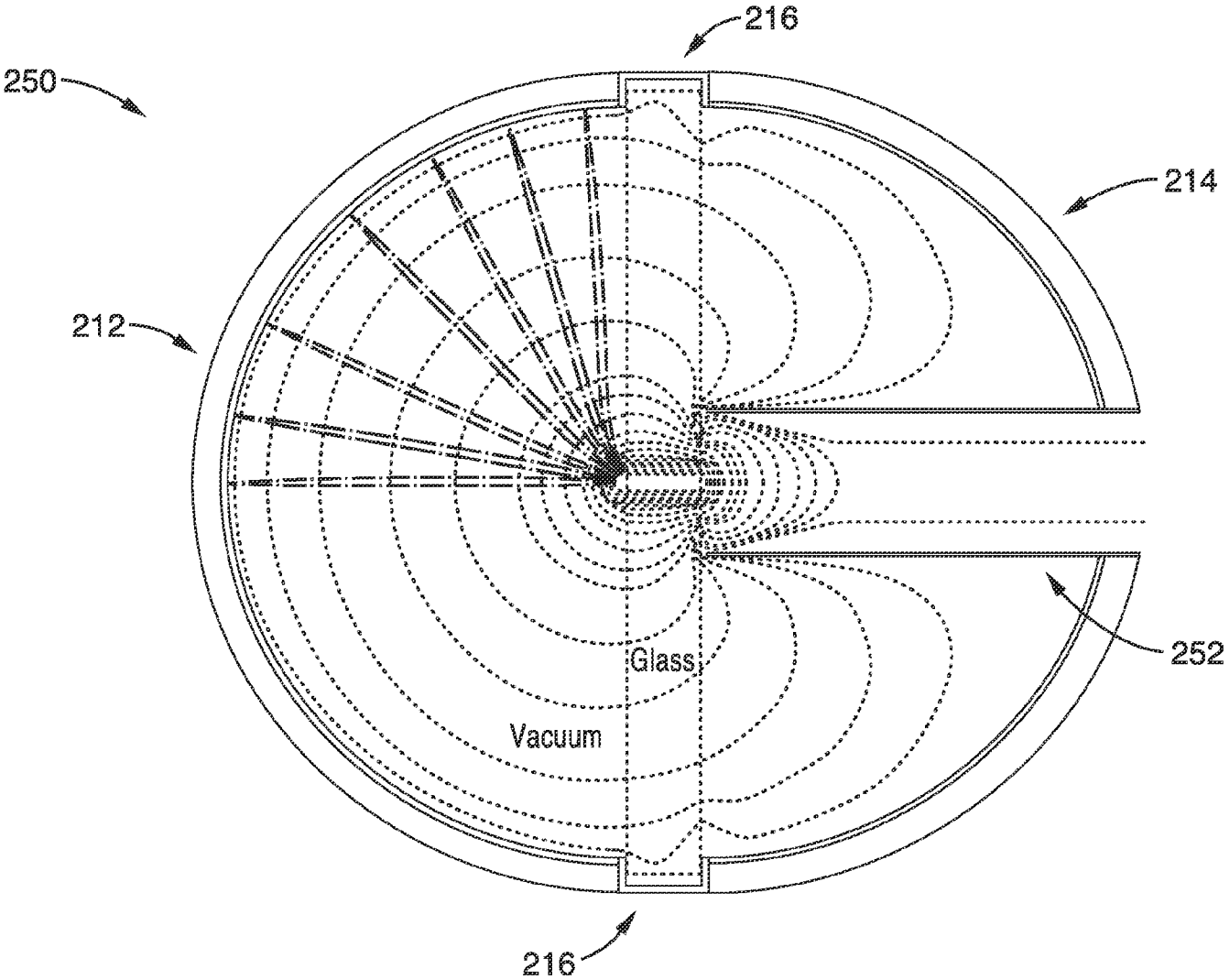
FIG. 18 is a schematic of a vacuum photodetector having an enlarged electrode with large annulus in a back hemisphere and showing equipotential surfaces according to an element of the present invention.

The two potentials required, namely ground potential and a high voltage (HV) potential, are transmitted into the vacuum enclosure through the thin-film vacuum sealing material, see FIG. 5, and FIG. 10, without any solid metal feedthroughs and/or electrodes. The electrostatic potential lines within the vacuum enclosure are properly shaped by the presence of a back hemisphere outside the vacuum enclosure (refer to FIG. 12 and FIG. 13). The back hemisphere is conductive on its internal hemispherical surface which is at ground potential. The basic electrostatic field configuration of the entire enclosure, depicted in FIG. 16 through FIG. 18, is formed by the interoperation of the vacuum hemisphere, the back hemisphere, and the central electrode section.

This system is designed in such a way that the potential lines intersect the surface of the base plate at small angles. The device configuration provides this potential surface pattern which assures minimum field distortion due to the presence of the dielectric material of the base plate, as well as providing for gentle charging of the floating potential rings. It should be noted that the numerical simulations presented herein do not account for the dielectrics, however taking these into account is an incremental task for obtaining fine corrections to the present solutions.

The base plate of the ABALONE device preferably has a set of densely deposited, concentric ultrathin film rings on its vacuum side. These rings act as passive, floating electrodes that naturally assume the appropriate potential some time after the device has been powered up. A similar pattern is preferably fabricated on the outside of the base plate, opposite from the vacuum side, however, it does not need to fulfill ultrahigh vacuum requirements and thus is more readily fabricated.

Since both the photocathode surface on the inside of the vacuum hemisphere, and the cathode within the backing hemisphere are at ground potential, the entire package is enclosed in the ground potential. In at least one embodiment, the evacuated hemisphere and the backing hemisphere are connected to one another through a vacuum seal on the perimeter of the vacuum hemisphere and a conduction bridge over the perimeter of the base plate. It should be appreciated that numerous forms of conducting seals may be utilized on the perimeter of the back hemisphere, such as metal-filled epoxy. Corrections and fine tuning of the electron focusing properties of the ABALONE device can be performed by making slight ring-pattern modifications on the outside surface of the base plate.

Contrary to typical vacuum electron devices, where an explicit adjustment of different potentials on a set of dedicated electrodes within the vacuum enclosure is necessary for adjusting the pattern, only a simple modification of the diameter of one or more electrodes outside of the vacuum enclosure provides focus adjustment.

FIG. 10 illustrates electron focusing in at least one embodiment 130 of ABALONE devices, with groups of photoelectron trajectories being shown. It will be noted that the thin film seal serves also as a high-voltage (HV) throughput. This particular design is optimized for precise timing, as the electrons from the entire photocathode are arranged to arrive simultaneously. A vacuum side hemisphere 132 is shown of a first optical material 134 (e.g., glass or quartz), within whose interior is disposed a photocathode 136. A photoelectron readout 138 is shown sealed 140 into a base 142. The periphery of hemisphere 132 is also sealed to base plate 142. A high voltage potential is shown being applied between these two seals. By way of example and not limitation, the hemisphere is five inches in diameter utilizing 20 kV as the high voltage potential. By way of example and not limitation the initial conditions for photoelectrons in the simulation presented above are with a 45° angular spread, and a 0.25 eV initial electron potential which corresponds to some typical figures.

Figure 11:
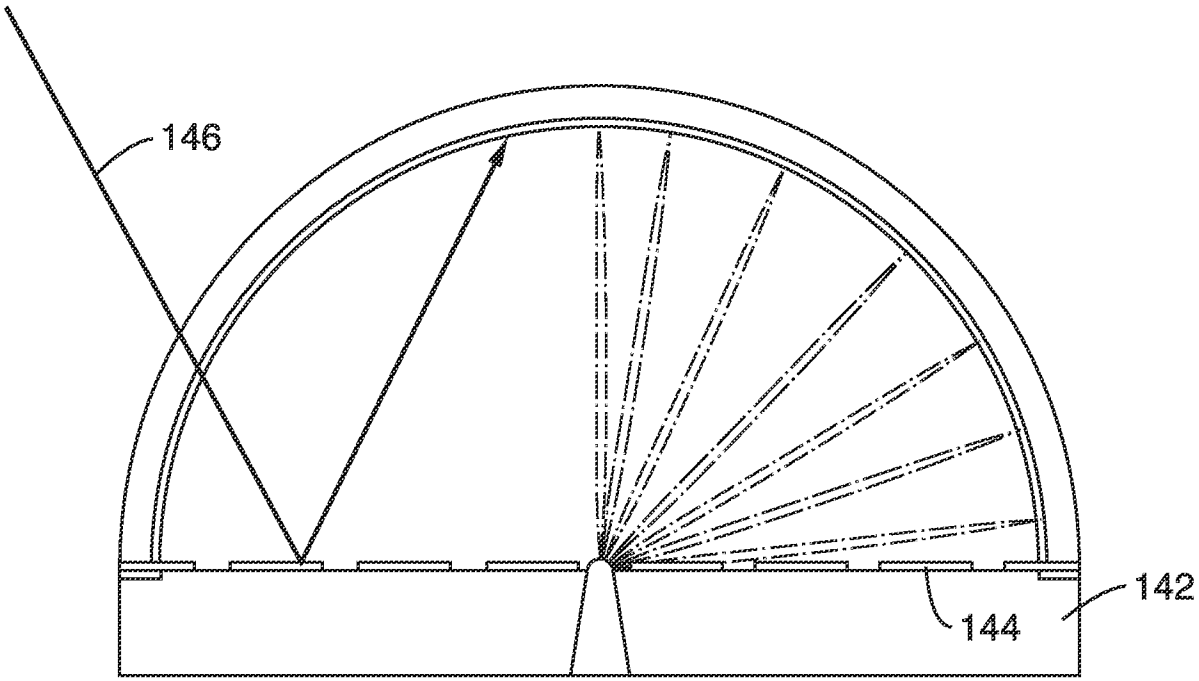
FIG. 11 is a schematic of a base plate configured with concentric electrode rings according to an element of the present invention.

FIG. 11 illustrates concentric ultrathin rings 144 of material on base plate 142 in at least one embodiment of the invention that provides: (a) a system of floating electrodes, (b) a reflector to reflect photons 146 back to the photocathode for a second conversion opportunity when they fail to convert in a first pass of the photocathode, and (c) as a non-evaporable getter (NEG) vacuum pump.

It should be appreciated that the photocathode is slightly transparent as this layer needs to be thin enough for electrons to traverse into the ultrahigh vacuum of the dome. The concentric rings (concentric paths), however, such as shown in FIG. 11 preferably comprise a different material as they provide concentric rings of floating passive electrodes. By way of example and not limitation, these concentric rings comprise a "getter" (NEG) material that absorbs residual gases and acts as a permanent vacuum pump, and as such are optically opaque. Although getter materials are not guaranteed to be reflectors, certain getters can be selected which provide the desired reflectivity, in particular non-evaporable getter materials, such as those developed at CERN. Getter materials can be obtained which provide activation at high temperatures or down to temperatures as low as about 180° C., which is compatible with Indium melting, and therefore present a great potential solution.

FIG. 12 illustrates an ABALONE detector 150 shown with a front sensor hemisphere 152 and a back hemisphere 154. After the sensor-equipped hemisphere 152 is evacuated and sealed, then the detector is backed by a symmetric dome 154 which provides for mechanical and electrical enclosure. The back hemisphere 154 is preferably attached using a low-cost seal (e.g. epoxy), and the dome may be evacuated, or filled with a HV-insulating material (e.g., dry air, silicon, or similar). Sensor hemisphere 152 is shown with an optical enclosure 160 upon which is disposed a photocathode 162, and which is sealed to a base plate 156 using a seal 164. The photoelectron readout 158 is shown centrally disposed on base plate 156 and is preferably similarly sealed. It should be appreciated that the electron readout comprises a means for directing photoelectrons, such as a light directing element (e.g., light pipe) or a combination scintillator and light directing elements. A cathode is not shown on the interior of back hemisphere 154 in this example embodiment, although its use enhances electric field properties.

It should be recognized that the device does not require metal electrodes or feedthroughs, and that none of the elements within the device are suspended within the vacuum, as is necessary within a PMT devices, further increasing the robust nature of the present invention. When the vacuum dome and the back dome are made of appropriate and sufficiently thick material, ABALONE may be used in deep-sea or ice experiments directly, without a pressure-protecting Bentos sphere. It should also be appreciated that in preferred embodiments of the invention, a ground potential encapsulates ABALONE and provides a field for "lensing" the photoelectrons to the sensor.

FIG. 13 illustrates an example embodiment 170 of an ABALONE detector depicted with a flat inner seal 188. A sensor hemisphere 172 is shown coupled to a base plate 176, to which is attached a back hemisphere 174. Sensor hemisphere 172 comprises an optical material 180 upon which is disposed a conductive photocathode 182, while the back hemisphere 174 is shown with an exterior material 180', upon which are similarly disposed a cathode 182'. Exterior material 180' is preferably of the same composition as the front material to withstand high pressures while providing symmetry of the enclosure, although other materials may be utilized without limitation. It should be noted that the back need not have a hemispherical configuration, as it may comprise different shapes or comprise a monolithic BACK-plate to which many different ABALONE pixels are attached within a flat-panel array. Element 187 depicts an optional light guide, which is not necessary in this configuration, as the G-APD can be placed right behind the thin windowlet that covers the hole.

The device in FIG. 13 is configured with a flat inner vacuum seal 188 as the exterior seal which is simpler to fabricate than those shown in FIG. 8 and FIG. 9. It should be noted that the plate (windowlet) can be fabricated from the same material as the dome and the plate, or alternatively of the bulk scintillator material itself, when the scintillator used is a crystal (e.g., LYSO, LSO, YAP, GaN, or similar). Electron acceleration in this device embodiment is more rapid (i.e., closer to the photocathode) than the previously described embodiment, making the device particularly well-suited for applications subject to magnetic fields. It should be noted that unlike the ABALONE device shown in FIG. 10, which was designed for precise timing so that electrons arrive simultaneously, the figure depicts a design in which electron acceleration is enhanced.

In one implementation a thin optical plate 180 (e.g., 6 mm diameter, 3 mm thick) is shown over a hole in base plate 176 at the center of reflectorized recess 178. For example the recess 178 is reflectorized and surrounded by separated concentric reflective rings. The back side of base plate 176 preferably contains a single metal coated area of approximately the same diameter as inner cone 178, with its diameter in combination with length 186 determining the focus.

Figure 14B:
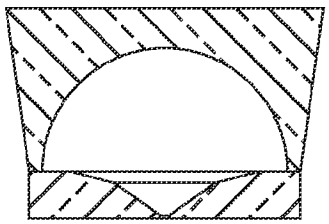
FIG. 14A through FIG. 14D are views of a hexagonal vacuum photodetector dome according to an element of the present invention.
Figure 14D:
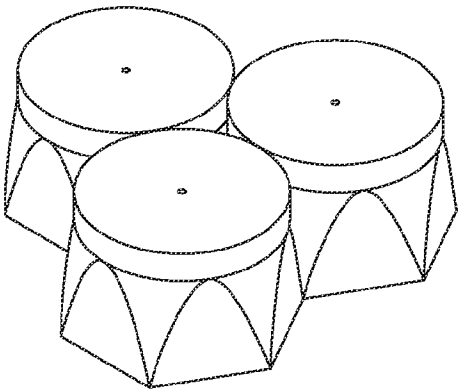
Figure 14A:
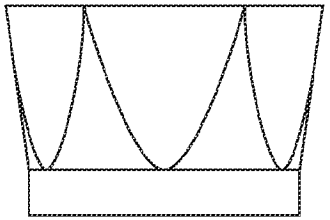
Figure 14C:
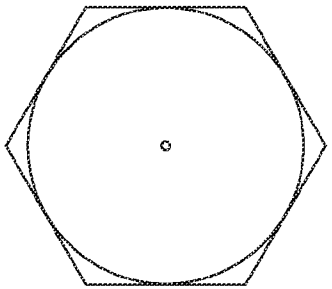

FIG. 14A through FIG. 14D illustrate an example hexagonal dome embodiment for ABALONE detectors, with only the outside shape of the dome differing from the hemispherical design described in previous sections. FIG. 14A depicts a side view, FIG. 14B a cross-sectional view, FIG. 14C a top view, while FIG. 14D depicts three of the enclosures arranged in an array configuration which can be expanded to any desired number of units. It should be appreciated that the hexagonal ABALONE configuration allows for creating a perfect flat-surface array with nearly zero dead area, as the sides have a coating which serves as a light reflector, to reflect light from the dead area between the hemispherical dome cavities to the corresponding active photocathode area. The optimal shape of the reflection surfaces depends on the application parameters and may be carefully optimized (here, they are assumed simply flat). The figure also incorporates a conical base plate as described for FIG. 13. which provides a simpler central seal. It should be appreciated, however, that either base plate can be used with either dome.

Figure 15:
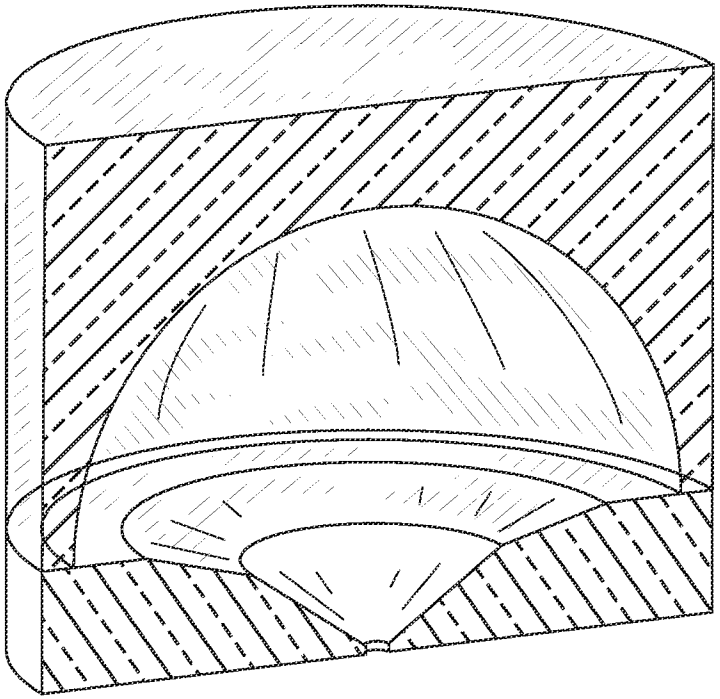
FIG. 15 is a pictorial view of a cylindrical vacuum photodetector according to an element of the present invention.

FIG. 15 illustrates a similar geometric configuration which can be implemented according to the invention, in particular a cylindrical ABALONE dome shape is exemplified. In addition, a variation of this can be implemented in a cubic shape, such as for use in medical applications. It should be appreciated that various shapes can be supported without departing from the teachings of the present invention.

FIG. 16 through FIG. 18 depict comparisons of equipotential surfaces within ABALONE devices configured with different electron focus tuning, showing different sizes of flat focusing disks, and different geometry and sizes of electrodes, which interoperate to provide a desired focusing pattern within the devices.

In FIG. 16 electron optics are illustrated with equipotential lines shown in the figure of an ABALONE device embodiment 210 having an evacuated hemisphere 212 and a backing hemisphere 214 separated by a base plate 216. A wide central electrode 218 and medium width focusing disk 220 are shown within backing hemisphere 214 which controls the electron optics.

In FIG. 17 electron optics are shown for an embodiment 230, which is similar to that shown in FIG. 16, having a sensor hemisphere 212 and a backing hemisphere 214 separated by a base plate 216. The central electrode 232 is shown extended farther toward the center of the joined hemispheres, and a wider focusing disk is shown 234. The device is shown with a modified diameter of the central +HV potential annulus of the central electrode on the outside face. A peripheral electron trajectory is clearly over focused. The size of the central ring outside the vacuum enclosure regulates the focusing properties, and may be fine-tuned if desired, such as following vacuum sealing of the device.

In FIG. 18 electron optics are depicted for an embodiment 250, which is similar to that shown in FIG. 16 and FIG. 17, having a sensor hemisphere 212 and a backing hemisphere 214 separated by a base plate 216. The central electrode 252 is shown with a larger diameter ring which extends very deeply toward the center of the joined hemispheres and lacking a focusing disk. The electron lensing of this ABALONE detector configuration is roughly optimized for simultaneous timing.

Figure 19:
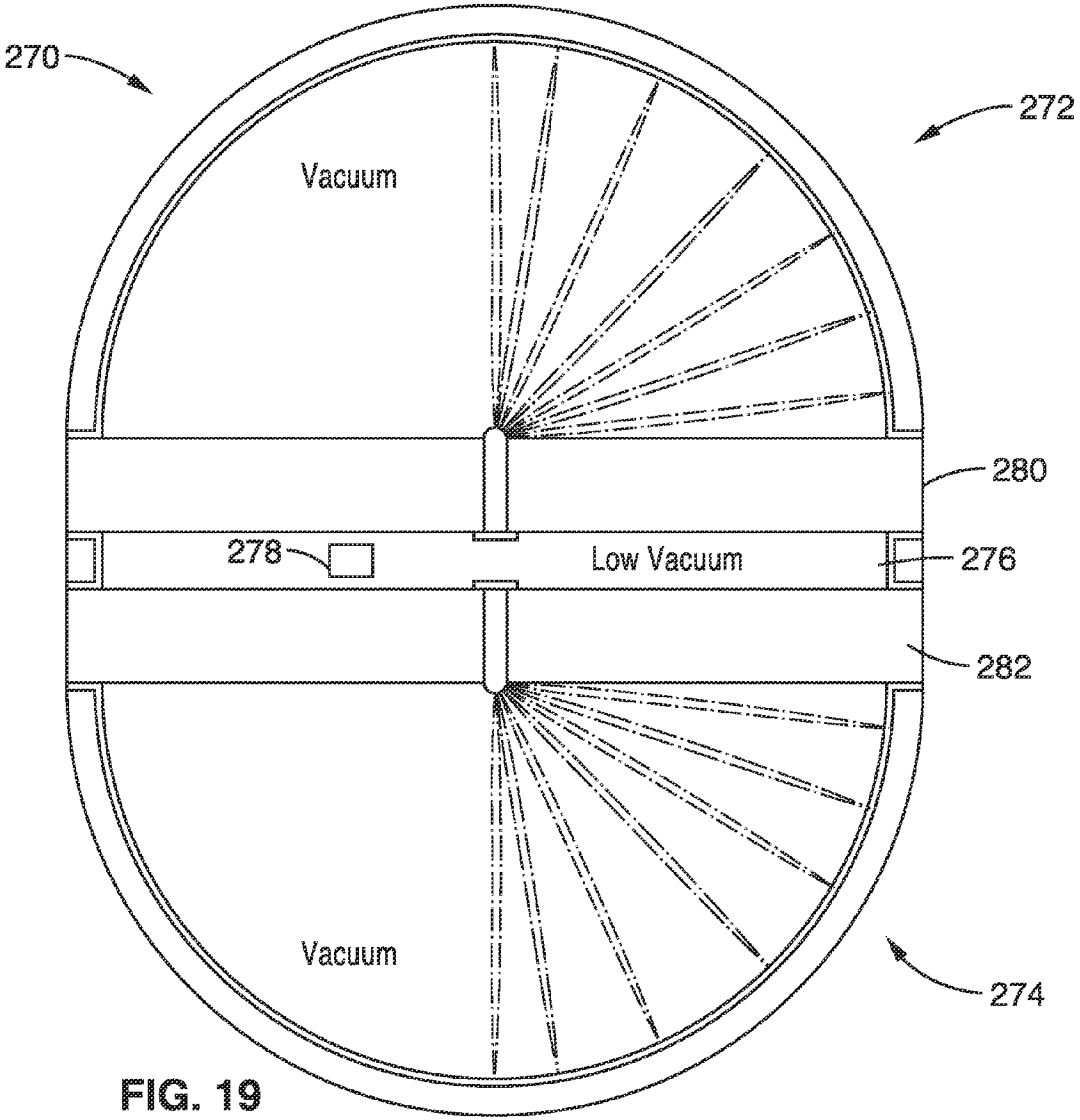
FIG. 19 is a schematic of a vacuum photodetector configured for detecting light arriving from any direction according to an embodiment of the present invention.

FIG. 19 illustrates an example embodiment 270 that is sensitive to light arriving from any direction. This configuration is particularly well-suited for use in a number of different experiments, such as deep sea and ice experiments. The structure of the device comprises a coupled pair of ABALONE devices 272, 274 oriented back-to-back, and connected with a short cylinder element 276 sharing the same high voltage supply 278 within a low vacuum area between backplates 280 and 282. This device is sensitive to light arriving from any direction, while being symmetric to enhance its robust nature in high pressure environments.

Figure 20:
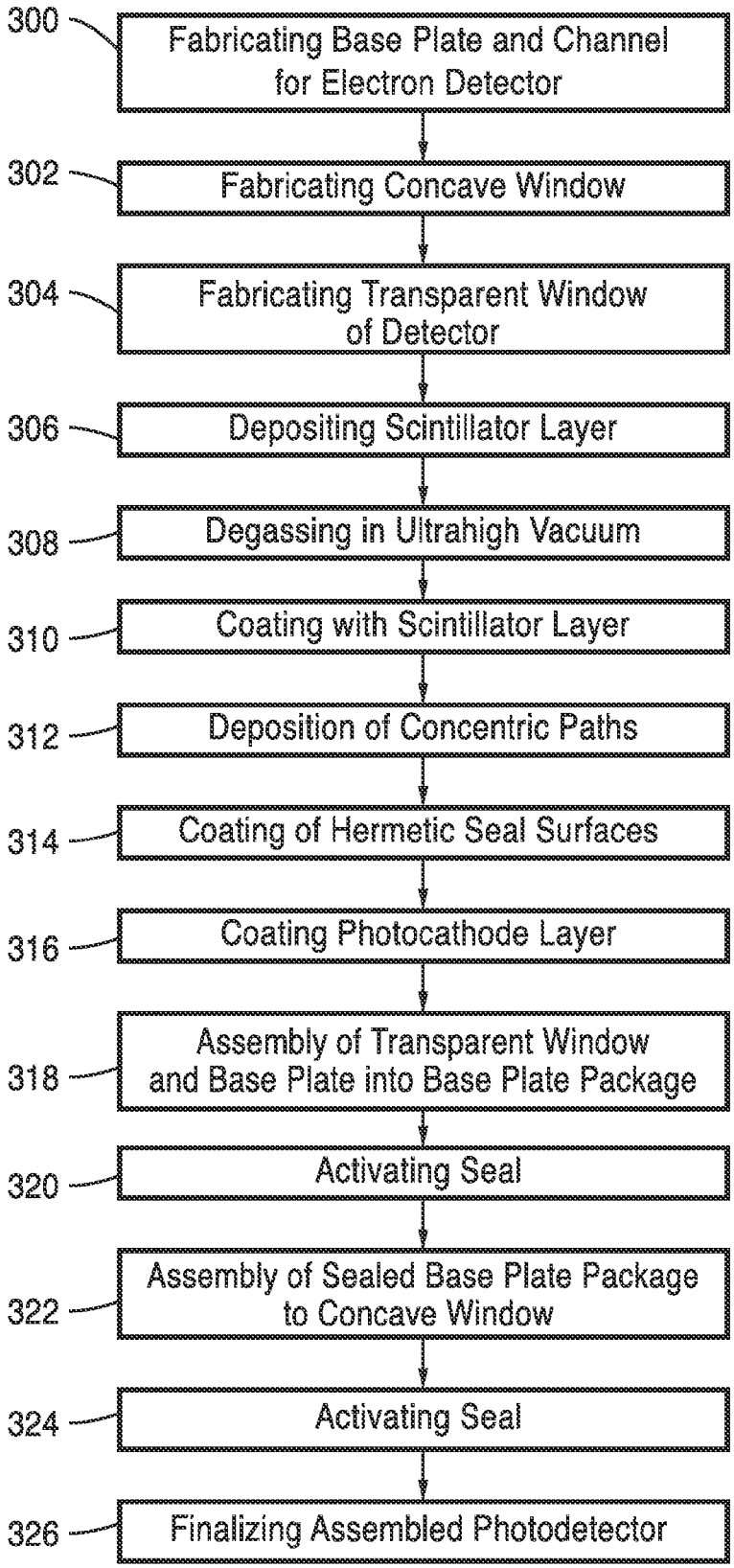
FIG. 20 is a flowchart of vacuum photodetector fabrication according to an element of the present invention.

FIG. 20 illustrates an example method of fabricating vacuum photoelectric devices according to the invention. A base plate is fabricated 300 with a through-channel for a photoelectron readout, through which light is directed to an electron detector on the non-vacuum side. A concave window (housing) is fabricated 302. A window is fabricated 304 for the detector to optically receive light from the interior of the assembled concave window and base plate. Deposition is performed 306 of a scintillator layer on the optically transparent window. In at least one embodiment, cleaning is performed of the base plate, through-channel, concave window, and optically transparent window of the electron detector to an ultrahigh vacuum level standard. Degassing is performed 308 of the base plate, through-channel, concave window, and optically transparent window of the electron detector in an ultrahigh vacuum. Coating is performed 310 of the optically transparent window with a scintillator layer, such as comprising a thin film of optically reflective and electrically conductive light reflective material, on the vacuum side of the optically transparent window. Deposition is performed 312 of optically reflective and electrically conductive thin film material over the vacuum face of the base plate, preferably as a plurality of concentric electrically conductive and light reflective paths. In at least one embodiment, the deposited material is composed of a NEG (non-evaporable getter) alloy material, preferably of the type which is activated at low temperatures (e.g., of up to 200° C.), such as the material currently used for fabricating the entirety of the beam pipes at the Large Hadron Collider at CERN.

Coating of hermetic sealing surfaces is performed 314 with oxide-free thin films of electrically conductive hermetic sealing materials. A thin photocathode layer is applied 316 to the interior of the transparent concave window. Various photocathode materials may be applied, including but not limited to traditional materials such as Cs—Sb, Sc—Na—K—Sb, Rb—Sb and others, but preferably utilizing ultrafast deposition techniques based on pulsed power lasers and electron beams, instead of traditional slow thermal evaporation methods that are typically utilized for PMT and HPD manufacture.

Assembly is performed 318 of the detector window into the base plate, and that seal is activated 320. Seals are activated in response to application of sufficient heat to the thin-film hermetic seal to activate a sealing action, which after cooling results in a permanently bonded and hermetically sealed base plate package comprising said photoelectron readout and the base plate. The assembled base plate is then assembled 322 with the transparent concave window, and its seal activated 324. It will be noted that these first and second set of seals are also electrically conductive and serve for connecting a high voltage potential and ground potential to the anode and photocathode, respectively. In addition, the seal in the base plate is preferably reflective to prevent light from leaving the path between windowlet and optical detector.

The NEG vacuum pumping material that constitutes the concentric electrode and reflector rings on the vacuum side of the base plate is thermally activated simultaneously with the thermal activation of the sealing surfaces and in such activated form is sealed within the vacuum enclosure where it keeps absorbing residual atoms and molecules from the enclosed vacuum and assuring a proper vacuum throughout the entire device lifetime.

The vacuum processing of the device is completed when the hermetically sealed and cooled package is removed from the vacuum production line.

It should be appreciated that the vacuum processing part of the device production is generally significantly more demanding and expensive than the remaining steps involved in production and assembly of the ABALONE devices. One of the key objects of the ABALONE invention is to render this vacuum assembly process into one that is simple, rapid, and low cost.

The photodetector assembly is finalized 326, such as by attaching a secondary light readout element along with fabricating electrical and/or optical connections for the package. In certain embodiments a properly configured backing hemisphere, with photocathode layer is attached to the opposite side of the base plate.

In one preferred embodiment of the invention a production line is configured for manufacturing the sensor devices. Three principle components are fabricated and assembled in the present invention, in particular a dome, windowlet and base plate, which are assembled within a high vacuum, while final fabrication steps are preferably completed outside of the vacuum production line. The constituent elements are preferably fabricated in other processes or by third parties and then assembled in an ultra-high vacuum (UHV) production line.

A preferred production line has three independent UHV lines each consisting of a row of vacuum chambers separated by gate valves. Each chamber is specialized for a certain task, like component insertion, plasma cleaning, electron bombardment cleaning, thin-film deposition of materials for oxide-free hermetic sealing, thin-film deposition of materials for NEG pumping, reflectors, floating electrode rings, thin-film deposition of materials that form a photocathode. The pieces move alone or in a multitude from one chamber to the other along this specialized line of chambers for proper processing until the pieces are ready for the final hermetic seal. The hermetic seal between the base plate and the windowlet is preferably fabricated in one specialized chamber where the two corresponding UHV lines converge. The hermetic seal between the dome and the base plate is preferably fabricated in another specialized chamber to which the dome preparation line and the already joined base plate and windowlet preparation lines converge. Once the hermetic sealing process is completed, the sealed piece moves to the cooling chamber, and from there to the load lock exit chamber that would preferably accumulate a large number of finished units before being opened for their removal.

In one implementation, fast thin-film deposition methods are utilized, such as but not limited to pulsed laser ablation and electron deposition. Masking of component areas, which are not to receive a thin-film coating, are preferably masked utilizing structures embedded within the deposition chambers. The same structures allow collection and reuse of the deposition materials. Photocathode material deposition is optimized for speed, quality, and uniformity such as by utilizing flash evaporation of premixed compounds.

Final assembly is preferably performed outside the UHV production line, such as with the attachment of the G-APD or other sensor, attachment of the HV supply or outside HV lead, attachment of the readout electronics and cables, sealing of the back-dome, testing, and so forth. If appropriate, additional assembly into flat panels can be performed, such as assembling individual ABALONE pixels onto a prefabricated monolithic back-plate featuring back-domes corresponding to each ABALONE pixel and centralized HV supply.

From the description herein, it will be appreciated that the present invention comprises a vacuum photosensor device which is scalable to different size arrays, and configured to simplify mass production and installation is described. The device has a housing with an evacuated first side at an ultrahigh vacuum and a second side which does not need high vacuum. The first side of the device is sealed to a base plate, having a central electron readout element, using an oxide-free sealing technique, with the deposited sealing areas serving as high voltage throughputs from the first to second sides. A conductive photocathode layer on the transparent first side converts photons to photoelectrons and amplifies (concentrates) the photoelectrons upon the readout. The first side and the second side form together an electrostatic lens that accelerates and focuses the photoelectrons upon the readout. The readout is preferably a scintillator layer which generates secondary light that passes through the base plate and is measured by an optical detector in the second side of the housing which is not subject to the ultrahigh vacuum.

It will further be appreciated that the invention can be embodied in various ways, which include but are not limited to the following:

1. A photosensor apparatus, comprising: a first housing of an optically transparent dielectric material window having a conductive layer as a photocathode for converting photons into photoelectrons; a base plate to which said first housing is attached; a through-channel centrally located on said base plate; a windowlet, within or covering said through-channel, configured for directing light from said first housing through said through-channel of said base plate; a scintillator surface on said windowlet for converting electron impacts upon said scintillator surface into secondary light transmitted through said windowlet; a first electrically conductive hermetic seal between a periphery of said first housing in electrical contact with said photocathode, and a periphery of said base plate; a second electrically conductive hermetic seal between said windowlet and said through-channel with said base plate and in electrical contact with said scintillator; wherein said first housing is configured with said first and second electrically conductive hermetic seals for retaining an ultrahigh vacuum level between said optically transparent dielectric material window and said base plate; a second housing disposed on a back side of said base plate having an interior shape for focusing photoelectrons converted at said photocathode layer of said optically transparent dielectric material window upon said windowlet in response to a high voltage applied between said first and second electrically conductive hermetic seals to which electrical connections are established within said second housing; wherein said second housing is not subject to said ultrahigh vacuum level of said first housing; an optical detector retained within said second housing and having a sensing area positioned in said second housing for receiving secondary light from said windowlet; and wherein an electrostatic field formed by said first housing, said second housing and said second electrically conductive hermetic seal focuses photoelectrons from said photocathode onto said scintillator surface, which has a surface area multiple orders of magnitude smaller than that of said photocathode.

2. The apparatus of embodiment 1, wherein said first housing has a concave shape.

3. The apparatus of embodiment 2, wherein said second housing has a concave shape and is configured with a conductive layer as a cathode.

4. The apparatus of embodiment 3: wherein said first and second housing have a hemispherical shape; wherein an electron lens is created in response to a nearly spherically shaped electrostatic potential formed between said photocathode in said first housing and said second housing acting as a cathode, and said second electrically conductive hermetic seal with said through-channel as the anode; and wherein said electron lens focuses and accelerates electrons from this nearly spherically shaped photocathode surface to the scintillator disposed upon said through-channel.

5. The apparatus of embodiment 1, wherein said second electrically conductive hermetic seal is reflective for retaining secondary light passing through said windowlet from being dispersed in said base plate.

6. The apparatus of embodiment 1, wherein said optical detector retained within said second housing is selected from the group of sensors consisting of semiconductor detectors, avalanche photo diodes, and Geiger-mode avalanche photo diodes.

7. The apparatus of embodiment 1, further comprising a high-voltage insulating material filling empty space within said second housing.

8. The apparatus of embodiment 1, further comprising a set of concentric electrically conductive, residual gas absorbing, and light-reflective thin film rings on said base plate acting as floating electrodes.

9. The apparatus of embodiment 1, wherein said optically transparent dielectric material of said first housing, said base plate, and said windowlet are shaped with an open geometry suitable for being removed from a mold.

10. The apparatus of embodiment 1, wherein said through-channel and said windowlet have an active area which is at least two orders of magnitude less than that of said photocathode.

11. The apparatus of embodiment 1, further comprising a high voltage source disposed within said second housing coupled to said first and second electrically conductive hermetic seal.

12. The apparatus of embodiment 1, wherein said first housing, said base plate, and said windowlet comprise materials selected from the group of dielectric materials consisting of transparent dielectric materials, glass, quartz, and fused silica.

13. The apparatus of embodiment 1, wherein said windowlet comprises a scintillator crystal material.

14. The apparatus of embodiment 1, wherein said scintillator surface comprises a thin film of electrically conductive and optically reflective material disposed over said windowlet.

15. The apparatus of embodiment 1, wherein said windowlet covering said through-channel has a diameter at least five times smaller than the outer diameter of said base plate.

16. The apparatus of embodiment 1, wherein said first and second electrically conductive hermetic seal comprises metallic layers deposited in an ultrahigh vacuum on a surface of each element to be joined.

17. The apparatus of embodiment 16, wherein after assembling each element to be joined, said electrically conductive hermetic seal is activated to seal joined elements.

18. The apparatus of embodiment 16, wherein said electrically conductive hermetic seal is electrically conductive, free of oxides and liquid above a temperature above approximately 160° C.

19. The apparatus of embodiment 16, wherein said electrically conductive hermetic seal comprises layers of chromium, gold and indium.

20. A photosensor apparatus, comprising: a concave hemispherical window of optically transparent dielectric material having a photocathode layer on its concave surface and with a flat ending annulus on a concave side in or near the plane passing through the center of curvature; a base plate comprising dielectric material which is hermetically sealed to said concave hemispherical window to retain an ultrahigh vacuum therebetween; a through-channel centrally located within said base plate; a windowlet disposed within or over said through-channel; a scintillator surface disposed on said windowlet for converting electron impacts upon said scintillator surface into secondary light transmitted through said windowlet and said through-channel; a first electrically conductive hermetic seal between said flat ending annulus of said concave hemispherical window and a periphery of said base plate; a second electrically conductive hermetic seal between through-channel and said windowlet and said base plate; wherein said photocathode layer converts photons striking said photosensor into photoelectrons and concentrates these photoelectrons from said photocathode upon said optical detector; wherein as surface area of said photocathode is multiple orders of magnitude larger than a sensing area of said optical detector, the photoelectron activity striking said apparatus is concentrated by many orders of magnitude; and at least one optical detector disposed in optical communication with said through-channel and said windowlet outside of said ultrahigh vacuum between said base plate and said concave hemispherical window, and configured for generating an electrical signal in response to registering secondary light from said scintillator.

21. A method for manufacturing a photosensor apparatus, comprising: fabricating a hemispherical window of optically transparent dielectric material; fabricating a base plate of dielectric material; fabricating a through-channel in said base plate; fabricating an optically transparent windowlet within or over said through-channel; deposition of a scintillator layer on said optically transparent windowlet; deposition of a thin conductive and optically reflective layer upon the scintillator layer; coating an interior surface of said hemispherical window with a photocathode; deposition of an optically reflective and electrically conductive thin film material in residual gas absorbing concentric rings on said base plate; creating a first set of hermetic sealing surfaces by depositing multiple metallic layers on a peripheral edge of said hemispherical window and a mating area on said base plate; creating a second set of hermetic sealing surfaces by depositing multiple metallic layers on said base plate and on said windowlet; assembly of said windowlet to said base plate; applying sufficient heat to activate said second set of hermetic sealing surfaces; cleaning and degassing of said base plate, hemispherical window, and windowlet to an ultrahigh vacuum level standard; assembly of said base plate to said hemispherical window within ultrahigh vacuum conditions; applying sufficient heat to said base plate to activate said concentric residual gas absorbing rings; applying sufficient heat to said first set of hermetic sealing surfaces to activate the seal between these surfaces and retain ultrahigh vacuum conditions therein; and finalizing the photosensor apparatus by attaching high voltage electrical connections to said first and second set of hermetic sealing surfaces, and an optical detector proximal said through-channel outside of the ultrahigh vacuum within said hemispherical window.

22. The method of embodiment 21, wherein said base plate, through-channel, and hemispherical window is fabricated in response to glass forming methods selected from the group of glass-forming methods consisting of molding, floating, pressing, cutting, grinding, and polishing.

23. The method of embodiment 21, wherein said cleaning of said base plate, through-channel, hemispherical window, and windowlet comprises a cleaning process utilizing a hot rarified gas atmosphere or plasma or energized electron beam or energized ion beam.

24. The method of embodiment 21, wherein said multiple metallic layers of said hermetic sealing surfaces are metal layers selected from the group of materials consisting of Chromium, Gold, Indium, Copper, Gallium and Bismuth.

25. The method of embodiment 21, wherein said sufficient heat for activating the seal action comprises heating a thin film hermetic seal containing indium until the thin film of indium is melted.

5. Discussion

The inventive ABALONE photosensor provides a scalable device suited to industrial mass production methods, increased structural integrity, simplified installation, and enhanced collection and sensing characteristics. The devices are particularly well-suited for use in the formation of flat-panel arrays with minimal dead area. They have no need of solid electrodes or feedthroughs. Each device is substantially insensitive to magnetic fields, geomagnetic and stronger, while being safe in response to accidental exposure to high light levels. Any desired number of devices can be combined into a large panel (e.g., flat-panel, curved panel) configuration with closely packed hemispherical elements, which may include interleaved parabolic cross-reflectors, or modulated hexagonal elements, for detectors requiring a continuous photosensitive surface without dead areas. Embodiments of the device can be nearly radioactivity-free. Vacuum photon detectors according to the invention should have a wide applicability High-resolution imaging units, for detectors that require high positional resolution and/or timing precision better than several nanoseconds. For the majority of applications, a fast-scintillator secondary photon source is coupled to a G-APD readout. In other applications an ultrafast channeltron or micro-channel readout can be utilized for applications that require time resolution better than approximately 100 ps, although subject to increased cost and complexity for the photoelectron readout element.

The ABALONE device technology can benefit multiple application areas including next generation large-area detectors for research, security, and medical imaging. The devices can aid efforts on virtually all experiments based on Cherenkov or liquid scintillator media (e.g., deep underground, deep sea, ice, atmosphere), cosmic, accelerator, atmospheric, and geoneutrino/antineutrino experiments. It can be utilized in proton decay search experiments, direct dark matter searching, and neutrinoless double beta decay search experiments. These application areas can benefit from unprecedentedly low level of intrinsic radiation which are offered when the devices are fabricated (e.g., CNC machined) from ultrapure quartz within the electrode-less ABALONE devices according to the invention. The devices may also be utilized in ground-based gamma ray observatories, in high-energy cosmic ray physics, and/or utilized in various accelerator-based physics experiments that require large-area photosensors. The beneficial cost and simplicity of the ABALONE technology could open new areas of use and lead to significantly more ambitious experiments than those currently contemplated.

LAPMT devices according to the present invention can be mass produced in a continuous production line, to fulfill large and stable markets which extend beyond the realm of research into areas such as homeland security and medical imaging. Each sensor provides a low cost per unit of photosensor area. The open topology of the devices opens the door to the possibility of mass production in continuous lines, in regard to both component production (e.g., mold engagement and release), and in the process of assembly, (e.g., direct access of cleaning beams and thin film deposition beams). The fabrication is performed without the need to permanently leave the deposition sources in the photosensor device.

Expensive material use is reduced as the configuration relies on a flat-on-flat, glass-to-glass vacuum sealing which only requires very thin films (up to 5 μm) of vacuum-deposited sealing material.

The inventive device eliminates the need for structural metallic feedthrough wires or electrodes, as well as the necessity of supporting elements within the interior vacuum of the sensor. Preferred embodiments of the device comprise only thin-film coated materials on solid, minimal-area surfaces. Additionally, no miniature or microscopic components are required in the device, as the smallest constructional elements can be made larger than one millimeter according to at least one embodiment.

The inventive photosensor minimizes the area exposed to vacuum, with no pores, microchannels, or patterns, from assembled high-tolerance industrially prefabricated components, and no need of handmade component parts.

In at least one embodiment, the components are assembled from high-purity (low radioactivity) materials, such as ultrapure quartz, without the need of structural metal electrodes or feedthroughs. The need for metal electrodes or feedthroughs is supplanted in the invention by utilizing vacuum-deposition of thin film layers.

The inventive photosensor provides numerous performance advantages over existing devices, as described in the following section by way of example and not limitation. A strong internal photoelectron concentration (amplification) is provided from the large photocathode to the small readout element (e.g., preferably a factor of approximately 1,000 to 10,000 (3 to 4 orders of magnitude) area reduction from the photocathode to the photoelectron readout element). The interoperation of the elements of the apparatus yield low levels of intrinsic radioactivity which are unprecedented for these devices. Full area coverage is provided by the device, meaning that photoelectrons can be detected across the full spatial extent of the device, with embodiments configurable for omni-directional 4-pi sensing.

In view of the above, it will be appreciated that an array formed from the devices will have minimal "dead area" between the pixels which are unable to register incident photoelectrons. The device provides single-photon resolution and sensitivity. It will be appreciated that single-photon resolution means the ability to resolve how many photons have been detected with accuracy to a single photon. Single-photon sensitivity means that the device can detect receipt of a single photon. The device provides single photon resolution when receiving up to at least five photons, above which resolution can drop off (e.g., such as to two photons, such as reading 11 photons when 12 photons were received, and so forth).

Collection efficiency for the device may reach up to 100% in at least one embodiment as described herein. It will be appreciated that collection efficiency is the measure of the percentage of photoelectrons which having been released from the photocathode within the device are subject to being registered by the sensor. Overall detection efficiency for the inventive devices is very high.

It will be appreciated that detection efficiency is difficult to quantify without a precise reference to actual photocathode materials, scintillators, G-APDs and so forth. It should be noted that overall photon detection efficiency is responsive to various factors, including: transparency of the window material, quantum efficiency of the photocathode (photocathode converts photons into photoelectrons), collection efficiency of the photoelectrons, efficiency of the detection of the photoelectrons (which has its own components). The present invention can increase efficiencies in each of these areas.

It should also be recognized that the present invention provides increased quantum efficiency of the photocathode, because the photocathode is not created 'in a bottle' as with conventional PMTs, but rather is fabricated in perfectly clean and controllable conditions to optimize thickness, chemical composition, uniformity over the area, and repeatability from one device to another.

The photosensor devices are structurally and electrically robust while providing installation simplicity. These devices are configured with robust and failure resistant electrical connections, such as utilizing a single low-voltage line for the entire device in at least one embodiment of the invention. In addition, the configuration of readout and power connections further contribute to mechanical and interconnective integrity of the devices, as at least one embodiment of the invention is taught which eschews the need of multi-pin HV sockets for each pixel as currently used in PMTs. More particularly, no pins and/or wire feedthroughs are required in devices according to the present invention which connect between electrical leads outside the vacuum enclosure to conductors within the vacuum enclosure.

Elements of the design and its packaging are mechanically robust as a consequence of utilizing a simple configuration having high manufacturing tolerances. Devices according to the invention provide a high level of safety against implosion, even when exposed to high pressure and vibration. Implementing arrays with the inventive device is facilitated by the strength of the design and the ease of mounting the apparatus. The apparatus is well-suited for application to very high pressure environments, even without the need of additional protection (e.g., Bentos spheres), such as for use in deep sea or ice neutrino experiments. Furthermore, elimination of package feedthroughs, electrodes, and elements supported within the interior vacuum make the photosensor well-suited for environments having a high level of vibration.

Embodiments of the invention can readily provide neutral buoyancy in water or liquid scintillator, such as in response to an appropriate quantity and distribution of materials, because the elements are not all contained within the interior vacuum of the device. Devices according to the invention are completely safe in case of accidental overexposure to strong light. The inventive devices are insensitive to the geomagnetic field, and significantly stronger fields, without mumetal protection.

It should be appreciated that the focus of photoelectrons in a conventional PMT device are subject to improper focusing, such as when their trajectories are bent in response to a magnetic field, to miss the dynodes. This arises in part because the photoelectrons are slow in these devices, due to the low acceleration potential existing between the photocathode and first dynode which is only about 100 volts in traditional PMT configurations. In contrast to the above, the ABALONE devices require only one voltage, such as approximately 20,000 volts, so electrons are quickly accelerated to higher speeds whose trajectories are proportionally less subject to bending in magnetic fields.

The photoelectron sensor of the invention has an ability to discriminate weak optical light flashes from the ubiquitous background noise, from Potassium 40 decays (40K decays) and from thermionic noise while providing high granulation (small pixel size), and fast time resolution. It will be noted that Potassium 40 is a radioactive element present in glass and in water.

The ABALONE devices have no need for expensive preamplifiers, as required by APDs and thus HPDs, because preferred embodiments provide strong amplification within the device itself, thanks to the application of Geiger-mode APDs which provide internal gain of more than a million. In addition, connection of the devices is simplified, as embodiments of the invention are described which have no need for expensive shielded cables, as they provide a strong output signal. The output signal can be configured as a strong analog signal, a digital signal, or an optical signal (analog or more preferably digital). It will be appreciated that data from the detector can be converted into a digital format to simplify communicating with an array of devices that for example communicate utilizing a multiplexing mechanism.

In one embodiment of the invention, a power supply voltage is supplied to each ABALONE unit (over an electrical connection that may be part of the structural retention of the sensor), while data is communicated with each unit over at least one optical fiber interconnecting each unit in an array. In one implementation, each unit in the array is configured to output data within a time slot selected for that unit, although other known forms of addressing can be utilized. In one embodiment of the invention, ABALONE devices are interconnected with at least one optical fiber. Signals and optical energy for conversion to electrical energy, can be received over a single fiber, or separate fibers, such as one for the optical power supply and one for the readout system. Carrying high frequency signals over the optical fiber has the benefit of eliminating cross-talk between signal lines while supporting a higher bandwidth than available when communicating electrical signals.

Regarding a single fiber system, it will be noted that optical encoding can be configured in an inverse mode with "0" states represented at high light intensities, or various protocols otherwise adopted to assure that light pulses are always present on the fiber from which sufficient electrical power can be derived, such as in response to an electrical output from a integral photoelectric cell. By way of example and not limitation, in a two fiber configuration, the power supply can be driven from an internal photoelectric cell which is illuminated by light through one optical fiber (e.g., preferably near-IR light), and the optical readout encoded into an electronic signal from a G-APD to optical, via another optical cable. It will be appreciated that an all-optical configuration of the ABALONE device allows producing simple miniaturized high and low voltage power supplies, while readily offsetting the entire photoelectron readout (G-APD and the optical converter) to a high voltage so that the photocathode can be retained at ground potential. It will be noted that numerous techniques are available for achieving these optical connections.

In addition, it will be appreciated that the ABALONE devices can be configured to communicate wirelessly. In view of the above, it will be recognized that the ABALONE devices according to the present invention lend themselves to being interconnected in various ways for a given application.

An important object for the present invention is to provide an open architecture (platform) for the industrial mass-production of photosensors. In particular, the fabrication process generally involves making three glass components, such as by fast molding, made possible by the configuration of the present invention and its open architecture, which overcomes the shortcomings of closed configurations which require blowing or spinning in molds. The ABALONE devices operate without the need of dynodes, structural feedthroughs, structural electrodes, glass-blowing and handwork in the fabrication process.

The inventive devices utilize different housing and sensing mechanisms than are provided by existing LAPMT devices. By way of example and not limitation, these includes the following. (1) The vacuum enclosure is not provided by a blown glass spherical envelope, but from a unique structure which is mass produced and easily hermetically sealed. (2) High voltage management is performed in a different manner than typical PMTs, such as including a high voltage converter within the entirely grounded enclosure of the devices, but outside of the interior vacuum. (3) Photon conversion into photoelectrons is facilitated by using vacuum deposition of photocathodes, such as bialkali, multialkali, or similar materials (e.g., containing various mixes of materials, such as including Sb, Cs, Na, and/or K), which provide significantly enhanced efficiency due to clean and precisely controlled processing. (4) Detection and amplification of photoelectrons is performed using small semiconductor sensors which are mass-produced, such as Geiger-mode avalanche photodiodes (G-APDs) as a readout of thin films of modern ultrafast and super-efficient scintillators.

The "vacuum part" of the inventive detector transforms incoming photons into electrons in an inexpensive photocathode layer, and the signal is concentrated (amplified) to a small area, such that a very small and inexpensive semiconductor sensor may be utilized for photoelectron detection. The sensor detects photoelectrons indirectly, through the scintillation light that the photoelectron creates in a small scintillator according to a light amplifier concept. This provides a very large concentration (e.g., approximately 3 to 4 orders of magnitude) of photon impact information from the large photocathode area to the small readout device which effectively bypasses Liouville's theorem by replacing a photon by a photoelectron, which is a charged particle that can be acted upon by an electrostatic field. Photoelectrons are focused upon a small optical sensor by electron lensing provided by the electric field potentials created within the inventive detector device.

It should be appreciated that although certain embodiments of the invention can be implemented using a sensor (e.g., APD) within the ultra-high vacuum side which is configured for directly reading the photons, this would require additional feedthroughs and generally increase device complexity, cost and fragility.

The interior vacuum of ABALONE detectors is retained using an oxide-free, low-temperature glass-to-glass sealing technique which is based on a vacuum-deposited multi-layer metal structure, such as consisting of Chromium, Gold, and Indium, while other combinations of materials are also possible.

ABALONE detectors according to the invention preferably utilize an oxide-free sealing technique which provides reliable sealing with minimal use of metal materials, and which can be fabricated in an uninterrupted vacuum production line.

The novel configuration of the present invention allows it to be mass-produced in large quantities, while it provides nearly 100% photoelectron collection efficiency (compared to about 70% in larger PMTs), and exhibits practically no dead areas when packaged according to described array configurations. Nearly the entire flat panel surface containing the inventive devices is sensitive to light. In contrast to this, it should be recognized that typical PMT arrays of equal area are composed of hundreds of individual PMT tubes, held together by a complex three-dimensional structure, a large fraction of which is dead area, such as about 50%. The devices according to the invention are robust to an unprecedented level, especially when compared to existing device technology.

An ABALONE device may be configured with a high-thickness vacuum enclosure which is able to withstand very high ambient pressures without the necessity of enclosing the device within a Bentos-sphere. It should be appreciated that a composite ABALONE flat-panel assembly, integrated upon an elastic, vibration-dampening composite structure, can offer an unparalleled level of robustness, vibration resistance, and resistance to humidity, which is ideal for any kind of challenging exposure, as well as for deployment of mobile radiation devices (e.g., on trucks, boats, helicopters etc.) in various applications, including homeland security and transportable medical imaging devices.

In contrast, the operating principles and structures of existing PMTs require numerous electrodes, dynodes, pins, and outside sockets along with voltage dividers and cable bundles that are intrinsically fragile and sensitive to vibration and corrosion. Unlike PMTs and HPDs which are very sensitive to noise introduced through the shielding and amplifier, the present invention has no need of shielded readout lines or for expensive preamplifiers.

The ABALONE devices are insensitive to magnetic fields which are stronger than the geomagnetic field. By contrast, PMTs already suffer from problems in response to the geomagnetic field, in which their detection efficiency depends on their specific orientation in space, and special mu-metal shielding of each individual PMT is necessary, although often impossible to implement without obscuration.

ABALONE devices are insensitive to accidental exposure to ambient light, such as may arise due to small cracks or scratches in the light shield on the scintillator, or to any kind of unexpected light flashes. This is because the G-APD readout devices are themselves insensitive to even ambient light while fully powered up, while ABALONE provides only limited secondary light amplification (factor 10-100) in the scintillator. In contrast, PMT devices and HPD devices are permanently damaged or burnt out when subjected to high light exposure levels.

A single, miniature, low-current high voltage power supply can be integrated into an ABALONE device, or even an entire array, or portion thereof. Each ABALONE unit is enclosed in a continuous ground-potential environment, subject to receiving only a single low-voltage input, while the high voltage is generated inside, within the non-vacuum area that is preferably encapsulated in a continuous ground potential. In contrast, in PMT arrays of equal area, composed of hundreds of PMT tubes, each PMT is individually supplied with 10 to 12 different levels of high voltage. That requires a dense network of high voltage and readout cables (thousands), with a separate high voltage power supply and a separate voltage divider for each PMT. The cost of connector sockets for these arrays is very substantial, and the arrangement is unreliable, in particular within environments having high levels of moisture or vibration. Additional problems arise with traditional PMT arrays, such as spurious effects that are very difficult to track down, including those arising from parasitic currents and oxidized contacts. Additionally, the weight of these supply structures and lines, as well as the volume occupied thereby, usually militate against the use of PMTs by a substantial margin.

The present invention leads to simplified installation, in particular in water, ice or liquid scintillator may be very simple as a result of the robustness of its body, while mounting a monolithic flat-panel-and-scintillator assembly should not be significantly less convenient than mounting a flat-panel TV display on the wall. In contrast, PMT arrays of equal area are very complex and fragile, with a large number of high voltage cables on their rear side, as discussed above. In general, it is a challenge to safely retain PMT voltage dividers as well as supply and readout cables for the PMTs in place. This retention is one of the reasons that current clinical gamma ray medical imaging equipment is so bulky.

ABALONE devices lend themselves to domestic production with minimized manual labor requirements, while traditional PMTs are very labor intensive, such that production is only feasible in developing countries which have low labor costs. As a consequence of the inventive structure of the ABALONE devices, the associated production plant can be configured in a manner similar to modern semiconductor and flat-panel TV screen production plants, while being significantly simpler in view of the lack of any miniature or microscopic features.

Although the description above contains many details, these should not be construed as limiting the scope of the invention but as merely providing illustrations of some of the presently preferred embodiments of this invention. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

What is claimed is:

1. A photosensor apparatus, comprising:

a first housing of an optically transparent dielectric material window having a conductive layer as a photocathode for converting photons into photoelectrons;

a base plate to which said first housing is attached;

a through-channel centrally located on said base plate;

a windowlet, within or covering said through-channel, configured for directing light from said first housing through said through-channel of said base plate;

a scintillator surface on said windowlet for converting electron impacts upon said scintillator surface into secondary light transmitted through said windowlet;

a first electrically conductive hermetic seal between a periphery of said first housing in electrical contact with said photocathode, and a periphery of said base plate;

a second electrically conductive hermetic seal, between said windowlet and said through-channel with said base plate, which is in electrical contact with said scintillator;

wherein said first housing is configured with said first and second electrically conductive hermetic seals for retaining an ultrahigh vacuum level between said optically transparent dielectric material window and said base plate;

a second housing disposed on a back side of said base plate having an interior shape for focusing photoelectrons converted at said photocathode layer of said optically transparent dielectric material window upon said windowlet in response to a high voltage applied between said first and second electrically conductive hermetic seals to which electrical connections are established within said second housing;

wherein said second housing is not subject to said ultrahigh vacuum level of said first housing;

an optical detector retained within said second housing and having a sensing area positioned in said second housing for receiving secondary light from said windowlet; and wherein an electrostatic field formed by said first housing, said second housing and said second electrically conductive hermetic seal focuses photoelectrons from said photocathode onto said scintillator surface, which has a surface area multiple orders of magnitude smaller than that of said photocathode.

2. An apparatus as recited claim 1, wherein said first housing has a concave shape.

3. An apparatus as recited claim 2, wherein said second housing has a concave shape and is configured with a conductive layer as a cathode.

4. An apparatus as recited claim 3:

wherein said first and second housing have a hemispherical shape;

wherein an electron lens is created in response to a nearly spherically shaped electrostatic potential formed between said photocathode in said first housing and said second housing acting as a cathode, and said second electrically conductive hermetic seal with said through-channel as the anode; and wherein said electron lens focuses and accelerates electrons from this nearly spherically shaped photocathode surface to the scintillator disposed upon said through-channel.

5. An apparatus as recited claim 1, wherein said second electrically conductive hermetic seal is reflective for retaining secondary light passing through said windowlet from being dispersed in said base plate.

6. An apparatus as recited claim 1, wherein said optical detector retained within said second housing is selected from the group of sensors consisting of semiconductor detectors, avalanche photo diodes, and Geiger-mode avalanche photo diodes.

7. An apparatus as recited claim 1, further comprising a high-voltage insulating material filling empty space within said second housing.

8. An apparatus as recited claim 1, further comprising a set of concentric electrically conductive, residual gas absorbing, and light-reflective thin film rings on said base plate acting as floating electrodes.

9. An apparatus as recited claim 1, wherein said optically transparent dielectric material of said first housing, said base plate, and said windowlet are shaped with an open geometry suitable for being removed from a mold.

10. An apparatus as recited claim 1, wherein said through-channel and said windowlet have an active area which is at least two orders of magnitude less than that of said photocathode.

11. An apparatus as recited claim 1, further comprising a high voltage source disposed within said second housing coupled to said first and second electrically conductive hermetic seal.

12. An apparatus as recited claim 1, wherein said first housing, said base plate, and said windowlet comprise materials selected from the group of dielectric materials consisting of transparent dielectric materials, glass, quartz, and fused silica.

13. An apparatus as recited claim 1, wherein said windowlet comprises a scintillator crystal material.

14. An apparatus as recited claim 1, wherein said scintillator surface comprises a thin film of electrically conductive and optically reflective material disposed over said windowlet.

15. An apparatus as recited claim 1, wherein said windowlet covering said through-channel has a diameter at least five times smaller than the outer diameter of said base plate.

16. An apparatus as recited claim 1, wherein said first and second electrically conductive hermetic seal comprises metallic layers deposited in an ultrahigh vacuum on a surface of each element to be joined.

17. An apparatus as recited claim 16, wherein after assembling each element to be joined, said electrically conductive hermetic seal is activated to seal joined elements.

18. An apparatus as recited claim 16, wherein said electrically conductive hermetic seal is electrically conductive, free of oxides and liquid above a temperature above approximately 160° C.

19. An apparatus as recited claim 16, wherein said electrically conductive hermetic seal comprises layers of chromium, gold and indium.

20. A photosensor apparatus, comprising:

a concave hemispherical window of optically transparent dielectric material having a photocathode layer on its concave surface and with a flat ending annulus on a concave side in or near the plane passing through the center of curvature;

a base plate comprising dielectric material which is hermetically sealed to said concave hemispherical window to retain an ultrahigh vacuum therebetween;

a through-channel centrally located within said base plate;

a windowlet disposed within or over said through-channel;

a scintillator surface disposed on said windowlet for converting electron impacts upon said scintillator surface into secondary light transmitted through said windowlet and said through-channel;

a first electrically conductive hermetic seal between said flat ending annulus of said concave hemispherical window and a periphery of said base plate;

a second electrically conductive hermetic seal between through-channel and said windowlet and said base plate;

wherein said photocathode layer converts photons striking said photosensor into photoelectrons and concentrates these photoelectrons from said photocathode upon said optical detector;

wherein as surface area of said photocathode is multiple orders of magnitude larger than a sensing area of said optical detector, the photoelectron activity striking said apparatus is concentrated by many orders of magnitude; and at least one optical detector disposed in optical communication with said through-channel and said windowlet outside of said ultrahigh vacuum between said base plate and said concave hemispherical window, and configured for generating an electrical signal in response to registering secondary light from said scintillator.

21. A method for manufacturing a photosensor apparatus, comprising:

fabricating a hemispherical window of optically transparent dielectric material;

fabricating a base plate of dielectric material;

fabricating a through-channel in said base plate;

fabricating an optically transparent windowlet within or over said through-channel;

deposition of a scintillator layer on said optically transparent windowlet;

deposition of a thin conductive and optically reflective layer upon the scintillator layer;

coating an interior surface of said hemispherical window with a photocathode;

deposition of an optically reflective and electrically conductive thin film material in residual gas absorbing concentric rings on said base plate;

creating a first set of hermetic sealing surfaces by depositing multiple metallic layers on a peripheral edge of said hemispherical window and a mating area on said base plate;

creating a second set of hermetic sealing surfaces by depositing multiple metallic layers on said base plate and on said windowlet;

assembly of said windowlet to said base plate;

applying sufficient heat to activate said second set of hermetic sealing surfaces;

cleaning and degassing of said base plate, hemispherical window, and windowlet to an ultrahigh vacuum level standard;

assembly of said base plate to said hemispherical window within ultrahigh vacuum conditions;

applying sufficient heat to said base plate to activate said concentric residual gas absorbing rings;

applying sufficient heat to said first set of hermetic sealing surfaces to activate the seal between these surfaces and retain ultrahigh vacuum conditions therein; and finalizing the photosensor apparatus by attaching high voltage electrical connections to said first and second set of hermetic sealing surfaces, and an optical detector proximal said through-channel outside of the ultrahigh vacuum within said hemispherical window.

22. A method as recited in claim 21, wherein said base plate, through-channel, and hemispherical window is fabricated in response to glass forming methods selected from the group of glass-forming methods consisting of molding, floating, pressing, cutting, grinding, and polishing.

23. A method as recited in claim 21, wherein said cleaning of said base plate, through-channel, hemispherical window, and windowlet comprises a cleaning process utilizing a hot rarified gas atmosphere or plasma or energized electron beam or energized ion beam.

24. A method as recited in claim 21, wherein said multiple metallic layers of said hermetic sealing surfaces are metal layers selected from the group of materials consisting of Chromium, Gold, Indium, Copper, Gallium and Bismuth.

25. A method as recited in claim 21, wherein said sufficient heat for activating the seal action comprises heating a thin film hermetic seal containing indium until the thin film of indium is melted.

* * * * *